US010793329B2

(12) United States Patent
Grady et al.

(10) Patent No.: US 10,793,329 B2
(45) Date of Patent: Oct. 6, 2020

(54) CINCHING WITH TOUCH FASTENING STRAPS

(71) Applicant: Velcro BVBA, Deinze (BE)

(72) Inventors: James T. Grady, Chester, NH (US); Mary L. Watts, Warner, NH (US)

(73) Assignee: Velcro BVBA, Deinze (BE)

( * ) Notice: Subject to any disclaimer, the term of this patent is extended or adjusted under 35 U.S.C. 154(b) by 0 days.

(21) Appl. No.: 15/949,154

(22) Filed: Apr. 10, 2018

(65) Prior Publication Data

US 2019/0308785 A1 Oct. 10, 2019

(51) Int. Cl.

| | |
|---|---|
| ***B65D 63/16*** | (2006.01) |
| ***A44B 18/00*** | (2006.01) |
| ***B65D 63/10*** | (2006.01) |

(52) U.S. Cl.

CPC ..... *B65D 63/16* (2013.01); *A44B 18/00* (2013.01); *A44B 18/0049* (2013.01); *A44B 18/0084* (2013.01); *B65D 63/109* (2013.01); *B65D 2563/103* (2013.01); *B65D 2563/107* (2013.01)

(58) Field of Classification Search

CPC ..... Y10T 24/14; Y10T 24/2708; A44B 11/06
See application file for complete search history.

(56) References Cited

U.S. PATENT DOCUMENTS

| | | | | |
|---|---|---|---|---|
| 3,000,384 A | | 9/1961 | Piers | |
| 3,543,977 A | | 12/1970 | Lockridge | |
| 4,149,540 A | | 4/1979 | Hasslinger | |
| 4,271,566 A | | 6/1981 | Perina | |
| 4,794,028 A | | 12/1988 | Fischer | |
| 4,963,410 A | * | 10/1990 | Bryant | A44B 18/00 24/16 R |
| 5,136,759 A | * | 8/1992 | Armour, II | A44B 18/00 24/16 R |
| 5,167,050 A | * | 12/1992 | Korsen | A44B 18/00 24/16 R |
| 5,201,100 A | * | 4/1993 | Cardinale | A44B 11/006 24/16 R |
| 5,260,015 A | | 11/1993 | Kennedy et al. | |

(Continued)

FOREIGN PATENT DOCUMENTS

| | | |
|---|---|---|
| WO | WO 92/05741 | 4/1992 |

OTHER PUBLICATIONS

PCT International Search Report and Written Opinion in International Appln. No. PCT/EP2019/057372, dated Jun. 4, 2019, 17 pages.

(Continued)

*Primary Examiner* — Robert Sandy
*Assistant Examiner* — Michael S Lee
(74) *Attorney, Agent, or Firm* — Fish & Richardson P.C.

(57) ABSTRACT

A cinching device includes: a buckle including a frame defining an opening; an elongate flexible strap coupled to one portion of the frame and extending away from the frame to a freestanding distal tongue receivable by the opening of the frame, the strap including a first face carrying a plurality of loop-engageable discrete fastening elements and an opposing second face carrying a loop material; and a tab coupled to another portion of the frame, the tab including an exposed touch fastening face engageable with at least one of: the plurality of fastening elements of the first face of the strap or the loop material of the second face of the strap.

21 Claims, 19 Drawing Sheets

(56) References Cited

U.S. PATENT DOCUMENTS

| | | | | |
|---|---|---|---|---|
| 5,316,022 | A | 5/1994 | Schiek, Sr. | |
| 5,518,795 | A | 5/1996 | Kennedy et al. | |
| 5,604,961 | A * | 2/1997 | Cole | A44B 18/00 24/306 |
| 5,802,676 | A | 9/1998 | Tolan | |
| 6,044,525 | A | 4/2000 | Sastre et al. | |
| 6,226,844 | B1 | 5/2001 | Lena et al. | |
| 6,551,539 | B1 | 4/2003 | Leach et al. | |
| 7,303,711 | B2 | 12/2007 | Gallant et al. | |
| 7,478,460 | B2 | 1/2009 | Gallant et al. | |
| 7,588,216 | B1 * | 9/2009 | Hoyl | H02G 3/30 174/50 |
| 8,069,537 | B2 | 12/2011 | Gallant | |
| 8,069,540 | B2 | 12/2011 | Obiols et al. | |
| 8,225,467 | B2 | 7/2012 | Gallant et al. | |
| 9,339,085 | B2 | 5/2016 | Watts et al. | |
| 2008/0201915 | A1 * | 8/2008 | Obiols | B65D 63/10 24/306 |
| 2009/0031594 | A1 * | 2/2009 | Kosmin | G09F 3/00 40/6 |

OTHER PUBLICATIONS

PCT Written Opinion of the International Preliminary Examining Authority in International Appln. No. PCT/EP2019/057372, dated Mar. 16, 2020, 10 pages.

PCT International Preliminary Report on Patentability Ch. II in International Appln. No. PCT/EP2019/057372, dated Jul. 14, 2020, 12 pages.

* cited by examiner

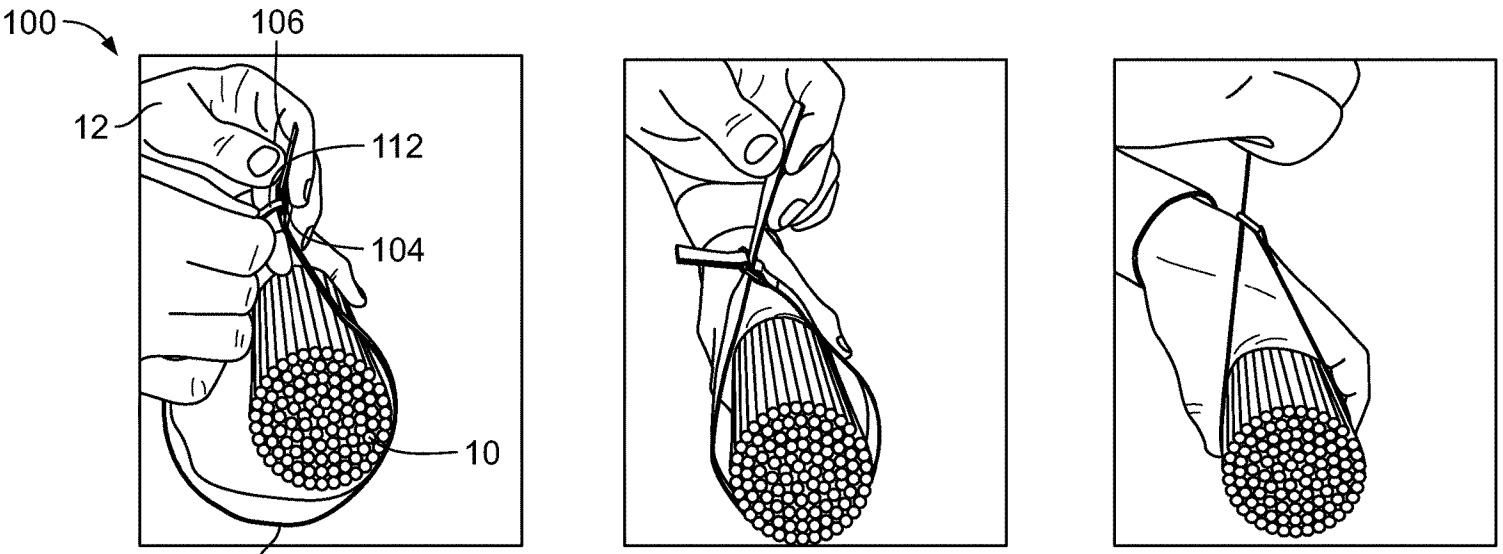
FIG. 5A
FIG. 5B
FIG. 5C
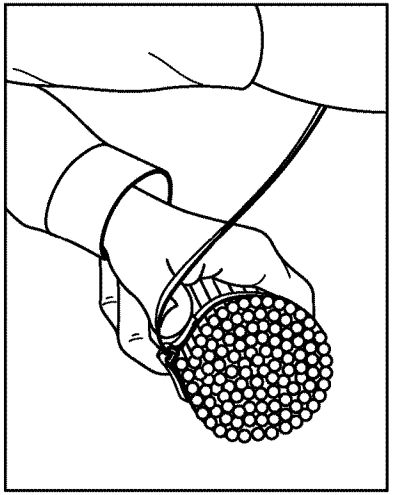
FIG. 5D
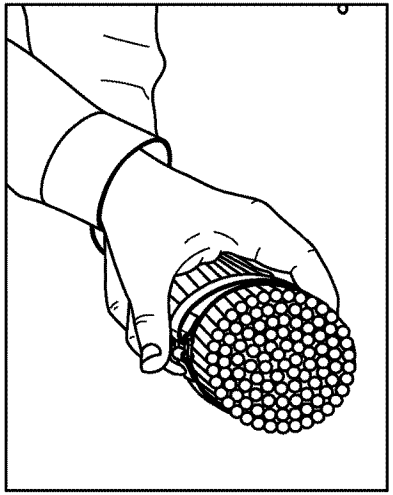
FIG. 5E

CINCHING WITH TOUCH FASTENING STRAPS

TECHNICAL FIELD

This specification generally relates to techniques (e.g., products and methods of use and manufacture) for cinching disparate objects together with touch fastening straps.

BACKGROUND

Self-engaging touch fastener products, such as certain wraps and ties, are useful to close bags or to secure bundled objects. U.S. Pat. No. 6,551,539, for example, describes a releasable strap for temporarily tying together a bundle of cables. The strap includes a loop material on one side and an arrangement of hook structures on the opposite side, configured to engage the loop material when the strap is wrapped around the cable bundle. One exemplary process of forming the hook-and-loop material of such a strap is described by U.S. Pat. No. 5,260,015, in which, during molding of the hooks on a rotary mold, a pre-formed loop fabric is laminated to the side of the base layer opposite that from which the hooks extend, so-called "in situ" lamination.

Despite the proven utility of releasable, self-engaging touch fastening straps, improvements are continuously sought in terms of usability and effectiveness.

SUMMARY

In a first aspect, a cinching device includes: a buckle including a frame defining an opening; an elongate flexible strap coupled to one portion of the frame and extending away from the frame to a freestanding distal tongue receivable by the opening of the frame, the strap including a first face carrying a plurality of loop-engageable discrete fastening elements and an opposing second face carrying a loop material, a significant majority of the plurality of fastening elements extending unidirectionally to overhang the first face of the strap; and a tab coupled to another portion of the frame, the tab including an exposed touch fastening face engageable with at least one of: the plurality of fastening elements of the first face of the strap or the loop material of the second face of the strap. In some examples, the plurality of unidirectional fastening elements includes an array of adjacent fastening elements extending across a limited portion of the first face of the strap.

In a second aspect, a cinching device includes: a buckle including a frame defining an opening; an elongate flexible strap coupled to one portion of the frame and extending away from the frame to a freestanding distal tongue receivable by the opening of the frame, the strap including a first face carrying a plurality of loop-engageable discrete fastening elements and an opposing second face carrying a loop material; and a tab coupled to another portion of the frame, the tab including an exposed touch fastening face engageable with at least one of: the plurality of fastening elements of the first face of the strap or the loop material of the second face of the strap. Engagement of the tab with the strap defines a shear plane parallel to the touch fastening face of the tab, the shear strength of the engagement being greater in one longitudinal direction along the shear plane than in an opposite longitudinal direction.

In a third aspect, a cinching device includes: a buckle including a frame defining an opening; an elongate flexible strap coupled to one portion of the frame and extending away from the frame to a freestanding distal tongue receivable by the opening of the frame, the strap including a first face carrying a plurality of loop-engageable discrete fastening elements and an opposing second face carrying a loop material; and a tab coupled to another portion of the frame, the tab including an exposed touch fastening face engageable with at least one of: the plurality of fastening elements of the first face of the strap or the loop material of the second face of the strap. The touch fastening face of the tab overlaps a portion of the strap when the tongue of the strap is received by the opening of the frame.

In a fourth aspect, a cinching device includes: a buckle including a frame defining an opening; an elongate flexible strap coupled to one portion of the frame and extending away from the frame to a freestanding distal tongue receivable by the opening of the frame, the strap including first and second touch fastening faces, the first face carrying an array of discrete male touch fastening elements, a significant majority of the fastening elements extending unidirectionally to overhang the first face of the strap; and a tab coupled to another portion of the frame, the tab including an third touch fastening face carrying an array of male discrete touch fastening elements engageable with the touch fastening elements of the first face of the strap.

In some examples of the first through fourth aspects, the frame of the buckle includes a rigid body having opposing, parallel arms to which the flexible strap and tab are respectively secured.

In some examples of the first through fourth aspects, the tab and flexible strap are permanently attached to the frame of the buckle.

In some examples of the first through fourth aspects, each of the plurality of fastening elements includes an upstanding stem rising from the first face of the strap and a head protruding integrally from a distal end of the stem to a tip.

In some examples of the first through fourth aspects, each of the plurality of fastening elements includes a cutout protrusion of a base of the strap. In some examples, the protrusion includes a barbed structure having an inwardly curved surface rising from a surrounding planar portion of the base.

In some examples of the first through fourth aspects, the plurality of fastening elements and a base of the strap include a contiguous mass. In some examples, the contiguous mass includes a molded mass of solidified resin.

In some examples of the first through fourth aspects, a proximal end of the strap is wrapped around a portion of the frame through the opening of the buckle and attached to the first face or the second face of the strap.

In some examples of the first through fourth aspects, the touch fastening face of the tab includes a loop material engageable with the fastening elements of the first face of the strap.

In some examples of the first through fourth aspects, the touch fastening face of the tab includes a plurality of fastening elements engageable with the loop material of the second face of the strap. In some examples, substantially all of the fastening elements of the tab extend unidirectionally to overhang the touch fastening face.

In some examples of the first through fourth aspects, the tab includes a base extending longitudinally between two ends, the base wrapped around a portion of the frame through the opening of the buckle, and a first portion of the base is coupled to a second portion of the base. In some examples, the first and second portions of the base include the two ends of the base. In some examples, the first and second portions of the base include respective arrays of interlocking male touch fastening elements.

In some examples of the first through fourth aspects, the tab includes a rigid body extending integrally from the frame.

In some examples of the first through fourth aspects, the tab carries a strip of resinous grip material extending along a length of the exposed touch fastening face.

In some examples of the first through fourth aspects, the flexible strap is a primary strap, and cinching device further includes an auxiliary fastening strap attached to the primary strap to overlap the first face of the primary strap, the auxiliary fastening strap including opposing touch fastening faces, at least one of which carrying a loop material engageable with the plurality of fastening elements of the first face.

In some examples of the first through fourth aspects, the first face of the strap carries a loop material in addition to the plurality of fastening elements. In some examples, the strap includes a base, and inwardly folded longitudinal edges of the base define a longitudinally continuous lane along the first face of the strap, the plurality of fastening elements residing inboard of the lane, and the loop material residing outboard of the lane.

In some examples of the first through fourth aspects, the second face of the strap carries a strip of resinous grip material extending along a length of the second face.

In some examples of the first through fourth aspects, the cinching device further includes an elastically stretchable band securing the strap to the frame of the buckle.

In a fifth aspect, a method of securing a strap about one or more objects includes: grasping a cinching device including a rigid buckle, an elongated flexible strap coupled to and extending from one end of the buckle, and a tab extending from an opposite end of the buckle; wrapping the flexible strap around the one or more objects; inserting a distal tongue of the strap through an opening defined by the buckle; and advancing the strap in a forward direction through the opening to tighten the strap, thereby cinching the strap around the one or more objects. The strap carries a first field of touch fastener elements exposed on an outer surface of the strap as wrapped about the one or more objects, and the tab carries a second field of touch fastener elements facing the outer surface of the strap and configured to engage the first field of touch fastener elements to resist loosening of the strap while permitting relative motion tightening the strap as the strap is cinched.

In a sixth aspect, a method of securing a strap about one or more objects includes: positioning a cinching device proximate the one or more objects, the cinching device including a rigid buckle, an elongated flexible strap coupled to and extending from one end of the buckle, and a tab extending from an opposite end of the buckle; wrapping the flexible strap around the one or more objects; inserting a distal tongue of the strap through an opening defined by the buckle; while grasping the tab and the flexible strap, advancing the strap in a forward direction through the opening to tighten the strap, thereby cinching the strap around the one or more objects; and engaging a first face of the strap carrying an array of discrete male fastening elements with a second face of the strap carrying a loop material.

In some examples of the fifth and sixth aspects, the tab is flexible and shorter than the strap.

In some examples of the fifth and sixth aspects, the tab is permanently secured to the buckle.

In some examples of the fifth and sixth aspects, the tab is a length of flexible touch fastener material wrapped about and pivotable about the opposite end of the buckle and exposed to the opening.

In some examples of the fifth and sixth aspects, the strap is permanently secured to the buckle. In some examples, the strap is secured to the buckle by an elastic strip.

In some examples of the fifth and sixth aspects, the second field of touch fastener elements includes a field of hook-engageable fibers exposed on a surface of the tab.

In some examples of the fifth and sixth aspects, one of the first and second fields of touch fastener elements includes a field of loops, and the other of the first and second fields of touch fastener elements includes an array of loop-engageable hooks oriented in a common direction so as to hold a shear load in only one of two opposite directions along the strap when engaged with the loops.

In some examples of the fifth and sixth aspects, the field of loops is carried on the strap and the array of hooks is carried on the tab. In some examples, the array of hooks is carried on the outer surface of the strap and the field of loops is carried on the tab.

In some examples of the fifth and sixth aspects, the strap carries a third field of touch fastener elements on an inner surface of the strap facing the one or more objects with the strap wrapped, the third field of touch fastener elements configured to releasably engage the first field of touch fastener elements with the strap overlapping itself.

In some examples of the fifth and sixth aspects, the method further includes loosening the tightened strap by: peeling the tab from the outer surface of the strap, and then retracting the strap through the opening.

In some examples of the fifth and sixth aspects, advancing the strap includes leaving the tab ungrasped as the strap is tightened.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

FIGS. 5A-5E are sequential diagrams illustrating installation of the cinching device of FIG. 1 in the first orientation of FIG. 3;

Certain aspects of the drawings may be exaggerated to better show the features, process steps, and results. Like reference numbers and designations in the various drawings may indicate like elements.

DETAILED DESCRIPTION

Figure 1:
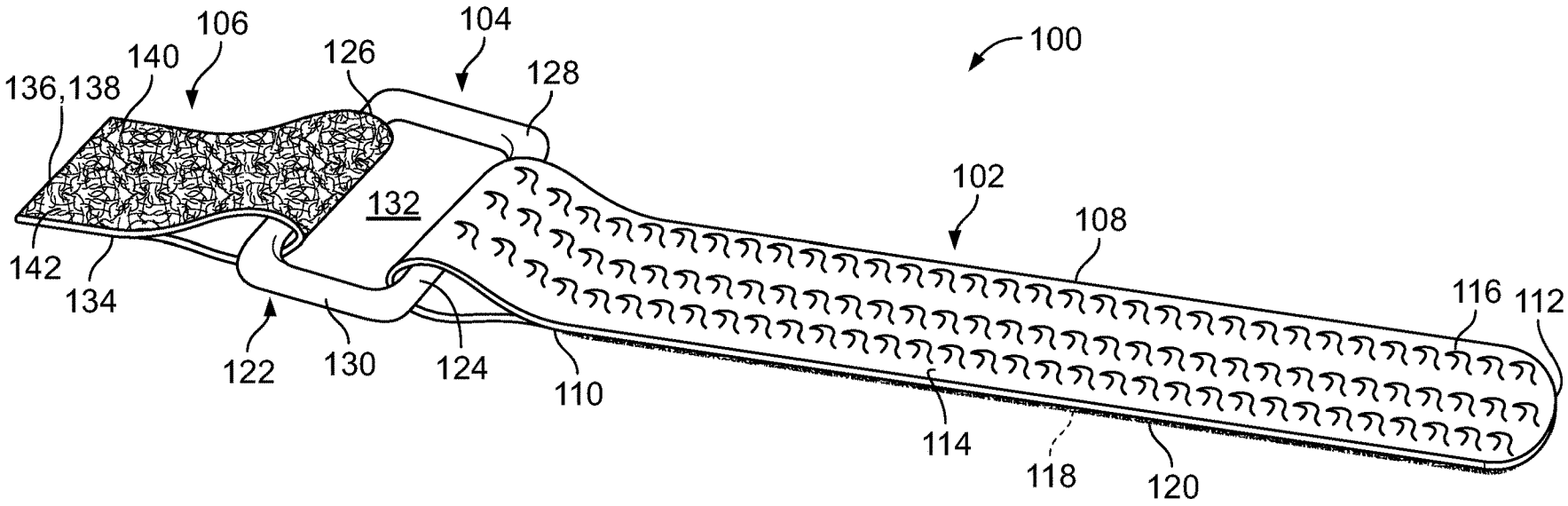
FIG. 1 is a perspective top view of a cinching device including a touch fastening strap.

FIG. 1 illustrates a cinching device 100 including a touch fastening strap 102, a buckle 104, and a tab 106. Strap 102 includes an elongate, sheet-form base 108 extending between a proximal end 110 and a distal tongue 112. Base 108 is a flexible structure that can be easily manipulated by a user to wrap strap 102 around the objects to be secured by cinching device 100. In this example, the edges of base 108 are substantially straight throughout the majority of its length, tapering inward proximate distal tongue 112 to allow a user to more easily route strap 102 through the buckle 104. Base 108 includes a first face 114 carrying a field or array of discrete male fastening elements 116 (e.g., hook structures) and a second face 118 carrying a field of loop material 120 engageable by fastening elements 116. The mating male fastening elements 116 and loop material 120 on opposing first and second faces 114,118 enable strap 102 to releasably engage itself when wrapped around one or more objects to be secured by cinching device 100.

Certain embodiments of the present disclosure feature male fastening elements that provide significantly different fastening characteristics in opposing longitudinal directions of the strap. For example, in one of two longitudinal directions, the male fastening elements may exhibit a significantly greater shear strength of loop engagement, beyond the inherent variability derived from the particular method of manufacture. This effect can be achieved by providing "significant majority" (e.g., at least 70%) of the fastening elements with a loop-engaging structural feature extending in a common direction along the length of the strap. In some examples, "substantially all" (e.g., at least 95%) of the fastening elements are unidirectional.

As discussed below, fastening elements of this type can be particularly advantageous in the present context because they enable the tab of the cinching device to cooperate with the strap to form a kind of ratcheting device. The ratcheting device permits forward movement of the strap through the buckle with relatively little resistance and inhibits backward movement of the strap through the buckle with a significantly greater amount of resistance, thus allowing the cinching device to be tightened using just one hand.

A particular type of hook-and-loop engagement mechanism providing such directional characteristics is described in detail below with reference to FIGS. 2A-2E, though various other suitable touch fastening configurations may also be used (e.g., hook-to-hook, hook-and-pile engagements). Further, while the term "hook" may be used throughout this disclosure for sake of convenience, it is understood that various other fastening shapes with directional characteristics are also envisioned (see, e.g., FIGS. 14A-14B).

Returning to FIG. 1, in this example, buckle 104 is provided in the form of a substantially rigid 'D-ring' frame 122 including opposing laterally extending arms 124,126 separated from one another in a parallel orientation by opposing longitudinally extending arms 128,130. The linked arms 124,126,128,130 of frame 122 define a central opening 132 that is appropriately sized and shaped for receiving strap 102 from the freestanding end of its distal tongue 112. Strap 102 is permanently coupled to arm 124 and extends longitudinally therefrom to distal tongue 112. Note that by "permanently coupled" we mean that the strap remains attached to the laterally extending arm of the buckle's frame during use of the cinching device. Stated plainly, unlike the releasable engagement of fastening elements 116 and loop material 120, strap 102 is not intended to become detached from buckle arm 124 at any point. In the illustrated example, strap 102 is permanently coupled to arm 124 by looping its proximal end 110 through opening 132 and around arm 124, and then securing proximal end 110 to an intermediate portion of strap 102 (e.g., via welding, fusing, stitching, or the like). While buckle 104 has been described in accordance with the particular structural configuration illustrated in FIG. 1, various other configurations are also contemplated. For example, a buckle having a rounded frame or an irregularly shaped frame could be employed without departing from the scope of this disclosure, insofar as these different frame configurations provide adequate support for the touch fastening strap and tab, and also provide an opening for receiving the distal tongue of the strap to facilitate cinching.

Tab 106 includes an elongate base 134 extending between opposing ends 136,138. Base 134 includes an outer touch fastening face 140 carrying a loop material 142 substantially covering its entire length and width. Tab 106 is permanently coupled to laterally extending arm 126 of the buckle's frame 122 in a similar manner as strap 102 with respect to arm 124. That is, elongate base 134 is routed through the buckle's central opening 132, wrapped around arm 126, and the ends 136,138 are secured to one another. This forms a relatively short, tab-like structure 106 with loop material 142 on either side extending from buckle 104 in an opposite longitudinal direction as strap 102.

Figure 2A:
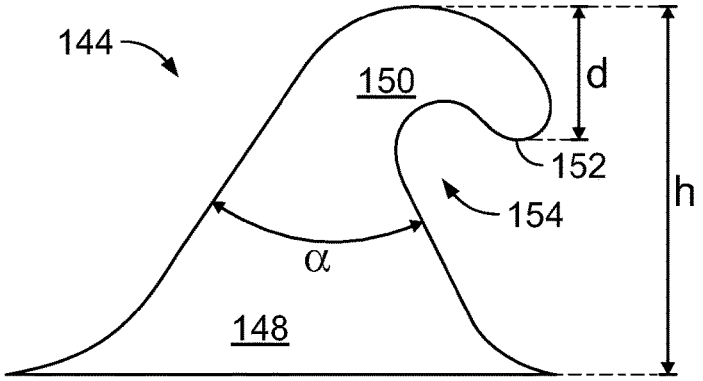
FIGS. 2A and 2B are side and end views of a first J-shaped hook.
Figure 2B:
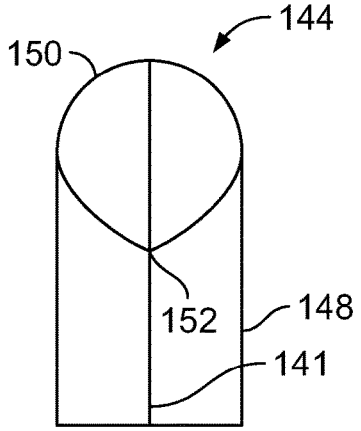
Figure 2C:
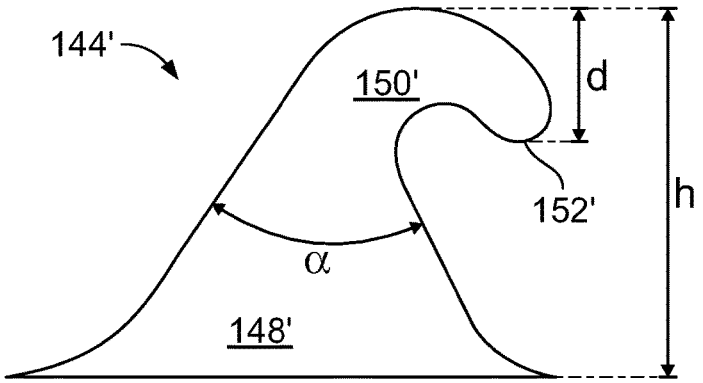
FIGS. 2C and 2D are side and end views of a second J-shaped hook.
Figure 2D:
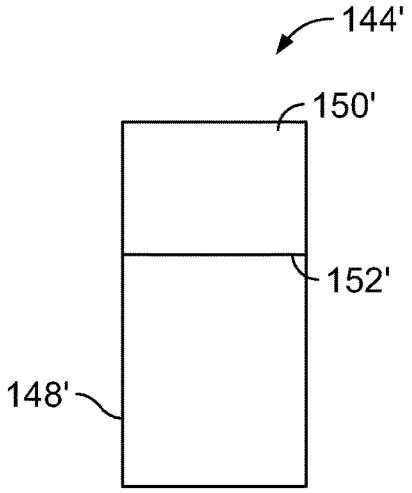

FIGS. 2A-2D illustrate example male fastening elements, J-hook structures in particular, that can be used in hook-and-loop touch-fastening closures of the present disclosure. The hook 144 of FIGS. 2A and 2B has a J-shaped profile and curved sides, such as may be molded in a cavity formed between two adjacent mold plates in a mold roll employed in the Fischer process described in U.S. Pat. No. 4,794,028, leaving a parting line 141 down the middle of the hook at the interface between the two mold plates. The pedestal stem portion 148 defines a rather large included angle $\alpha$ (e.g., about 61.5 degrees) between front and rear edges. The head portion 150 has a re-entrant tip 152, meaning that it extends downward toward the base of the hook to form a concave crook 154 for entrapping loop fibers. The tip 152 extends downward to a distance "d" from the uppermost surface of the hook, and the entire hook has an overall height "h", as measured normal to the base. The hook 144' of FIGS. 2C and 2D also has a J-shaped profile, but has flat sides as seen in FIG. 2D. Thus, its tip 152' extends completely across the hook, and the upper surface of its head portion 150' presents a rather broad surface to the mating material. The stem portion 148' defines the same included angle α, the tip 152' also extends down to a distance "d", and the hook 144' also has an overall height "h".

Figure 2E:
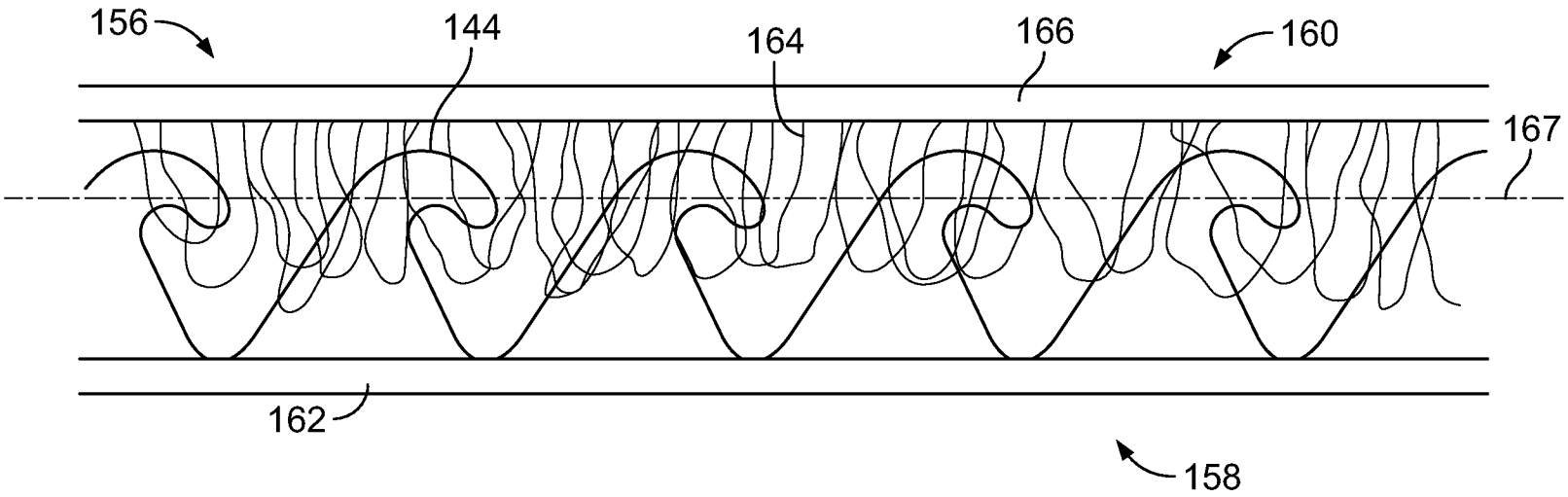
FIG. 2E is a side view of a hook-and-loop engagement mechanism.

FIG. 2E illustrates an example closure 156 formed between mating touch fasteners 158,160, which, in the context of this disclosure, may be opposite sides of the same strap. As shown, touch fastener 158 includes an array of molded J-hooks 144 extending integrally from base 162 as a contiguous mass of solidified resin; and touch fastener 160 includes a field of loop material 164 formed on a base 166. Touch fasteners 158,160 are shown here in an engaged state, with the loops 164 of touch fastener 160 trapped within the concave crooks of hooks 144 carried on touch fastener 158.

The engaged hooks 144 and loops 164 can be disengaged by peel or shear loads. In either case, when the applied peel/shear force reaches the strength of closure 156, hooks 144 deform and/or loops 164 sever to release the loops from the crooks of the hooks. For a strap to withstand several engagement and release cycles, it is preferable to design the hook-and-loop system such that the hooks deform at a lower load than that at which the loops sever (i.e., a hook-limited closure).

When a peel load is applied, loops 164 are pulled upward at an acute angle through the head portion 150 of hooks 144. The application of a shear load pulls loops 164 laterally across hooks 144 at a neck region between stem portion 148 and head portion 150 (see FIGS. 2A-2D). In sum, shear disengagement is characterized by a relative sliding motion between the fasteners along a defined plane 167 (the "shear plane") that typically runs parallel to the fastening face of the respective touch fasteners. Peel disengagement, on the other hand, is characterized by progressively pulling the fasteners apart from one another at an angle from shear plane 167. As is visually apparent, the thickness of hooks 144 is greater at the neck region than head portion 150 (see FIGS. 2A-2D). As such, a greater magnitude of force is necessary in shear as compared to peel in order to release loops 164. This effect is heightened by the fact that the closures discussed herein involve thousands of individual fastening elements. Further still, as explained in U.S. Pat. No. 4,271,566, the entirety of which is incorporated herein by reference, shear disengagement requires the concurrent release of essentially all inter-engagements between individual mating fastening elements. Therefore, the force required to disengage mated hooks and loops by shear (the "shear strength") is greater than the force required to pull them apart by progressive peeling (the "peel strength"). This paradigm proves particularly useful in the context of the cinching devices of the present disclosure, as the relatively high shear strength tends to inhibit unintentional release of the bundled items, and the relatively low peel strength enables a user to easily release the device from the bundle when desirable.

Note that the array of J-hooks 144 in the example of FIG. 2E is an arrangement of parallel rows along the base 162 of touch fastener 158. Moreover, as shown, hooks 144 are formed such that the head portions 150 extend unidirectionally to overhang base 162 with their re-entrant tips 152. This arrangement of hooks 144 with head portions 150 oriented in the same direction is referred to as a "one-way hook" configuration. To reiterate the discussion above, in the context of this disclosure, an array of "one-way hooks" is characterized by at least a significant majority of the discrete fastener elements being hook structures with head portions that extend forward from the stem in a common direction. As noted above, by "significant majority," we mean that at least 70% of hooks extend unidirectionally. Touch fasteners featuring one-way hooks present significant shear strength when pulled in a direction opposing the directed re-entrant tip of the head, and little to no shear strength when pulled in the opposite direction.

Figure 3:
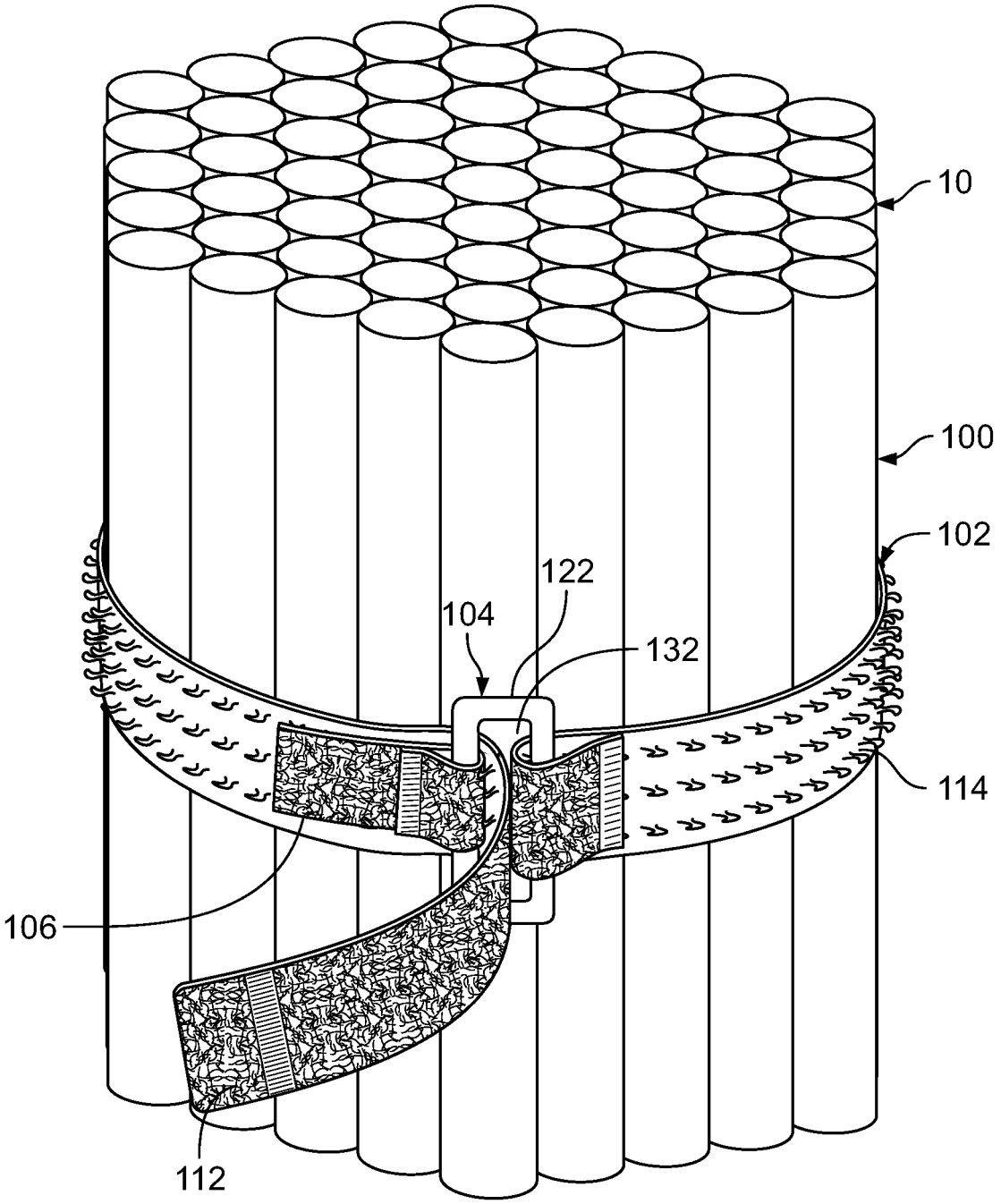
FIG. 3 is a perspective side view of the cinching device of FIG. 1 securing a bundle of cables in a first installation orientation.
Figure 4:
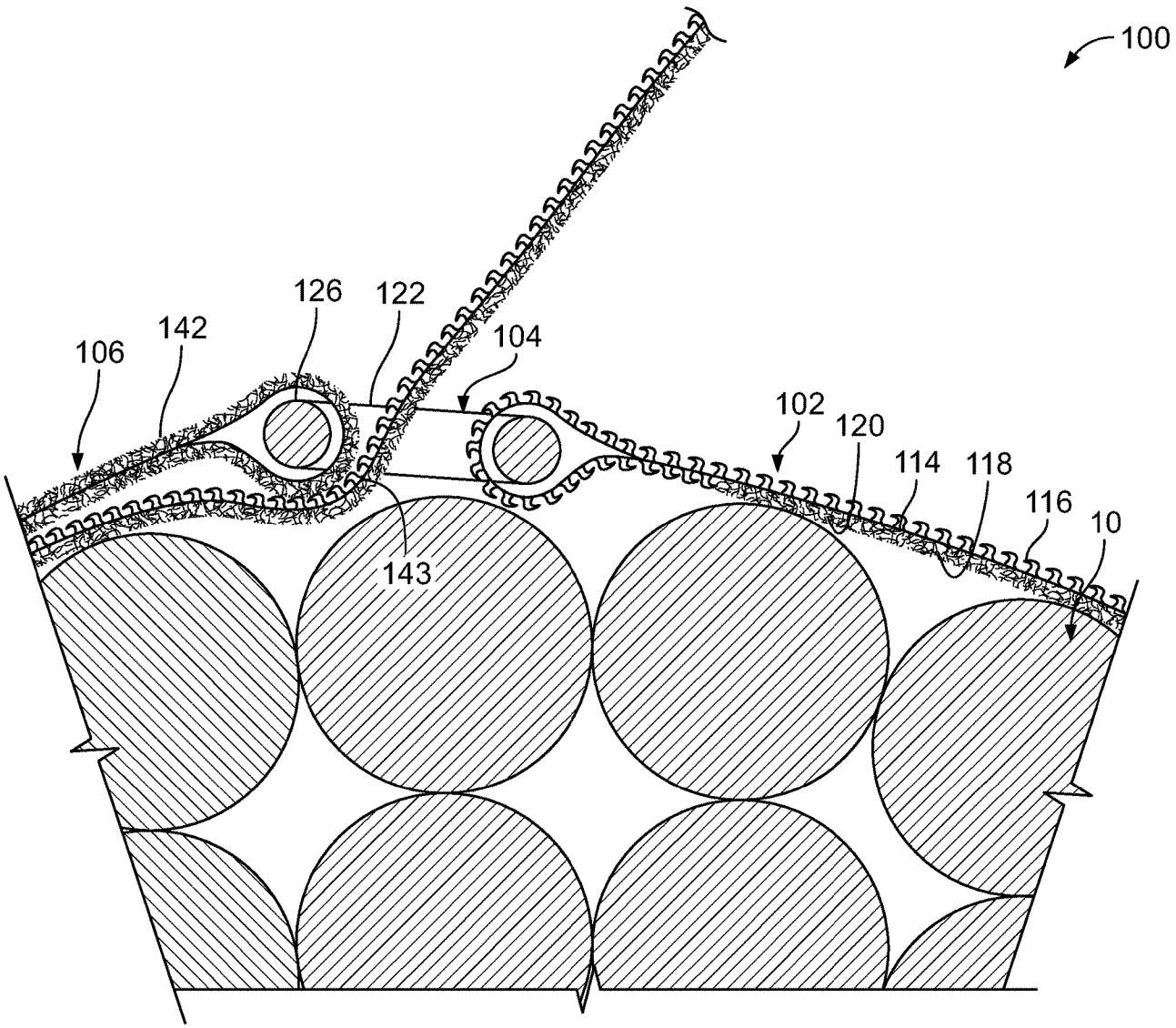
FIG. 4 is a cross-sectional side view of the cinching device of FIG. 1 in the first installation orientation of FIG. 3.

FIGS. 3-4 illustrate cinching device 100 securing a bundle of cables 10. In this particular example, cinching device 100 is installed in one of two orientations described in this disclosure. In the orientation of FIGS. 3-4, strap 102 is arranged hook-side-out, with its first face 114 directed outward, away from cables 10, and its second face 118 directed inward. As shown, strap 102 is wrapped loosely around cable bundle 10, and distal tongue 112 is inserted through the central opening 132 of the buckle's frame 122. Strap 102 is then tightened around cables 10 by pulling strap 102 further through buckle 104. As illustrated most clearly in FIG. 4, as strap 102 is tightened, tab 106 is forced down against the strap's first face 114, forming a shear plane between the strap's fastening elements 116 and the tab's loop material 142. As noted above, because fastening elements 116 are 'one-way hooks' extending unidirectionally in a manner that is opposite the motion of strap 102, there is little to no shear resistance to the forward motion of strap 102 through buckle 104. On the other hand, backward movement of strap 102 is inhibited by the comparatively high shear resistance resulting from engagement between fastening elements 116 and loop material 142, thus forming a touch fastening ratchet mechanism. In this particular example, tab 106 is urged against strap 102 to enhance the ratcheting effect. There are at least two ways of achieving this. A user could press the tab 106 against strap 102; and/or friction at an interface 143 between tab 106 and strap 102 along the curved surface of arm 126 could apply a force on tab 106 as strap 102 is advanced forward through buckle 104. Once tightened, the cable bundle 10 is secured by preloaded engagement of fastening elements 116 with loop material 142 of tab 106. The free end may then be held against cable bundle 10 by engaging loop material 120 on the strap's second face 118 with male fastening elements 116 on the strap's first face 114.

Figure 6:
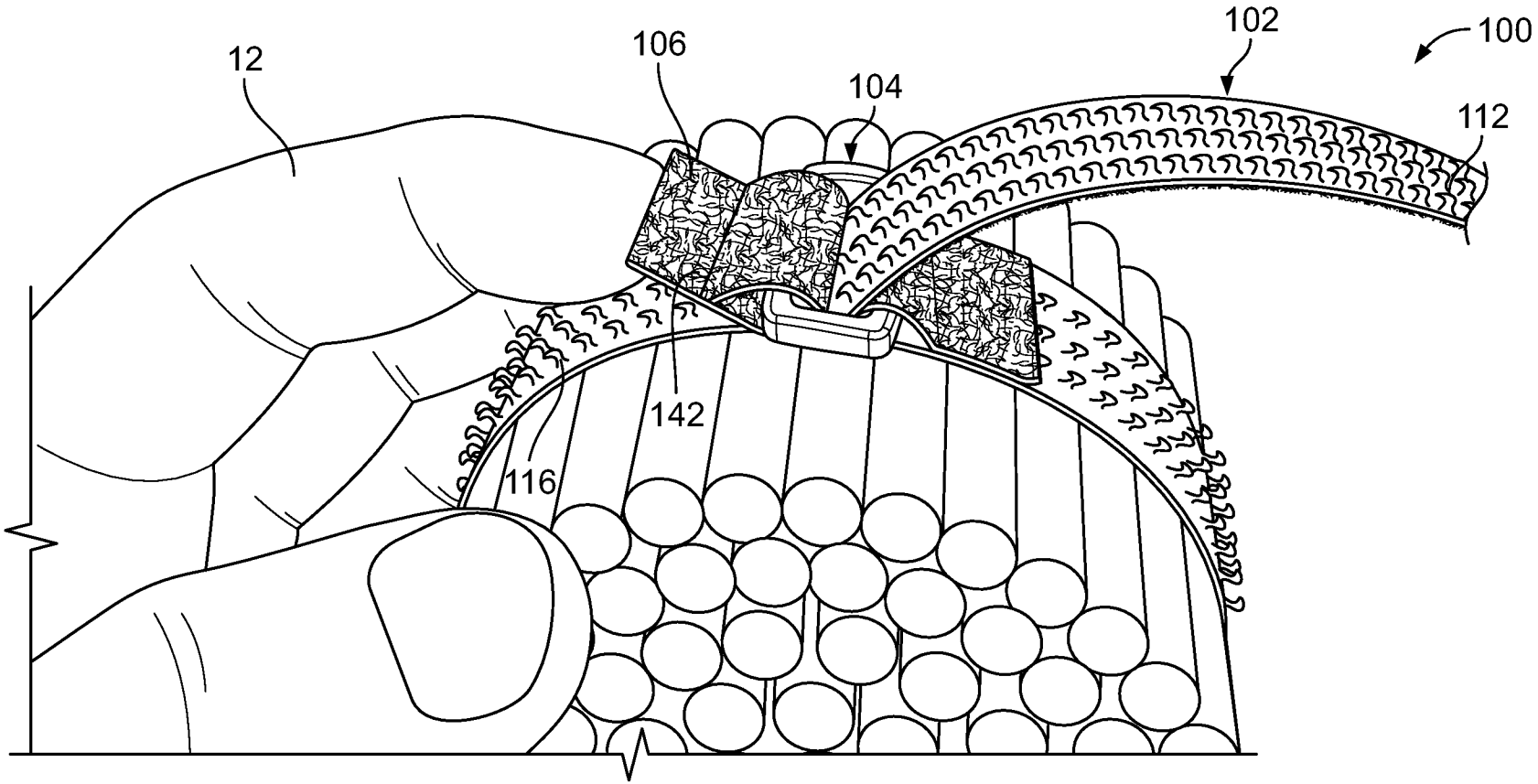
FIG. 6 is a perspective side view of the cinching device of FIG. 1 illustrating release of the first installation orientation of FIG. 3.

FIGS. 5A-5E illustrate the above-described installation sequence with cinching device 100 oriented such that strap 102 is hook-side-out. Note how, once its distal tongue 112 has been routed through buckle 104, strap 102 can be tightened around the cables 10 with just one of the user's hands 12 due to the force of friction urging tab 106 against strap 102 to provide the ratcheting effect. FIG. 6 illustrates how cinching device 100 can be easily released from the bundle of cables 10 by simply pulling/pushing upward on tab 106 with a finger of the user's hand 12 to release loop material 142 from male fastening elements 116 with peel force. With the touch fastening ratchet mechanism disassembled, strap 102 can by retracted through buckle 104 without significant shear resistance.

Figure 7A:
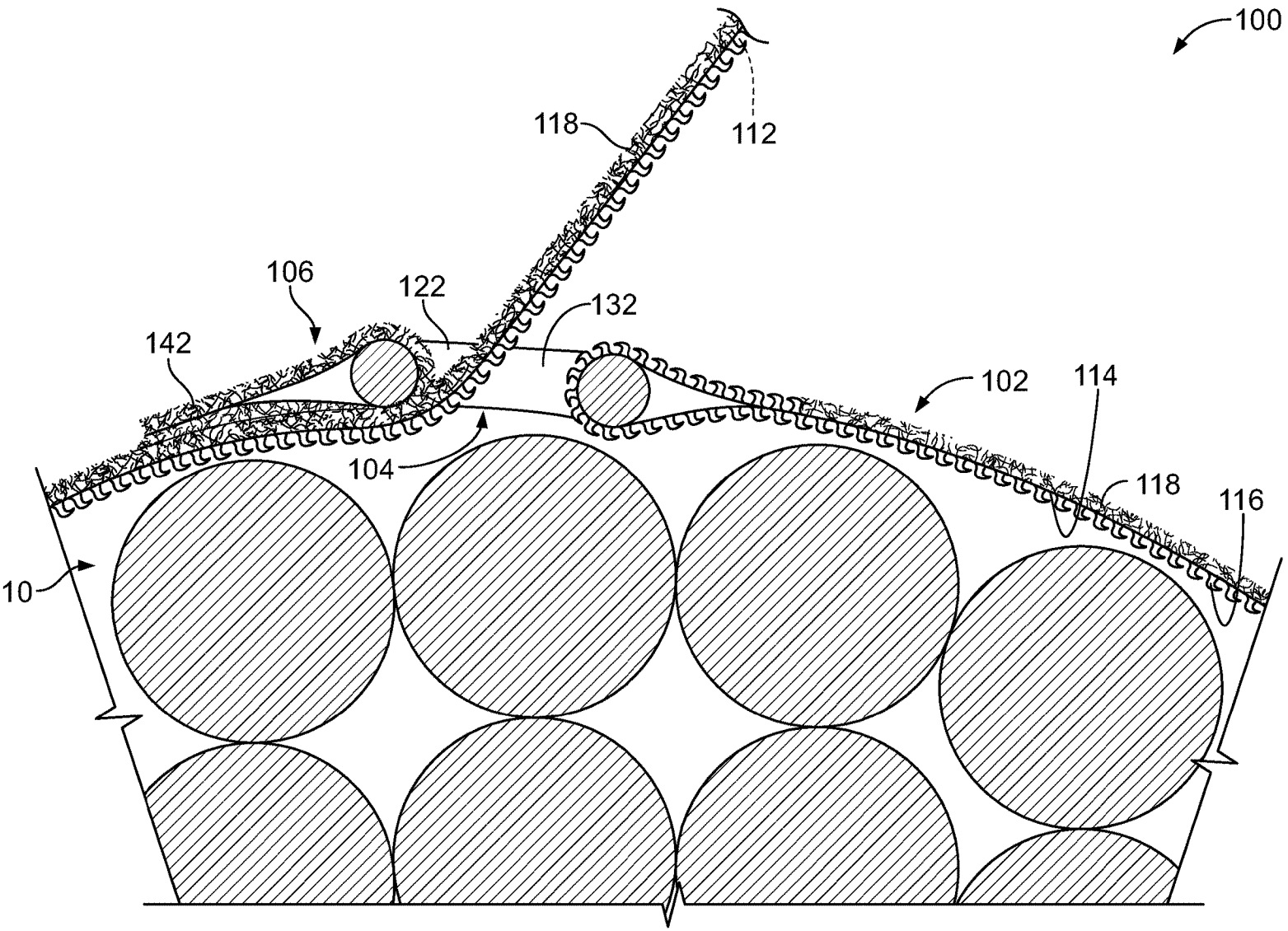
FIGS. 7A-7B are cross-sectional side views of the cinching device of FIG. 1 in a second installation orientation.
Figure 7B:
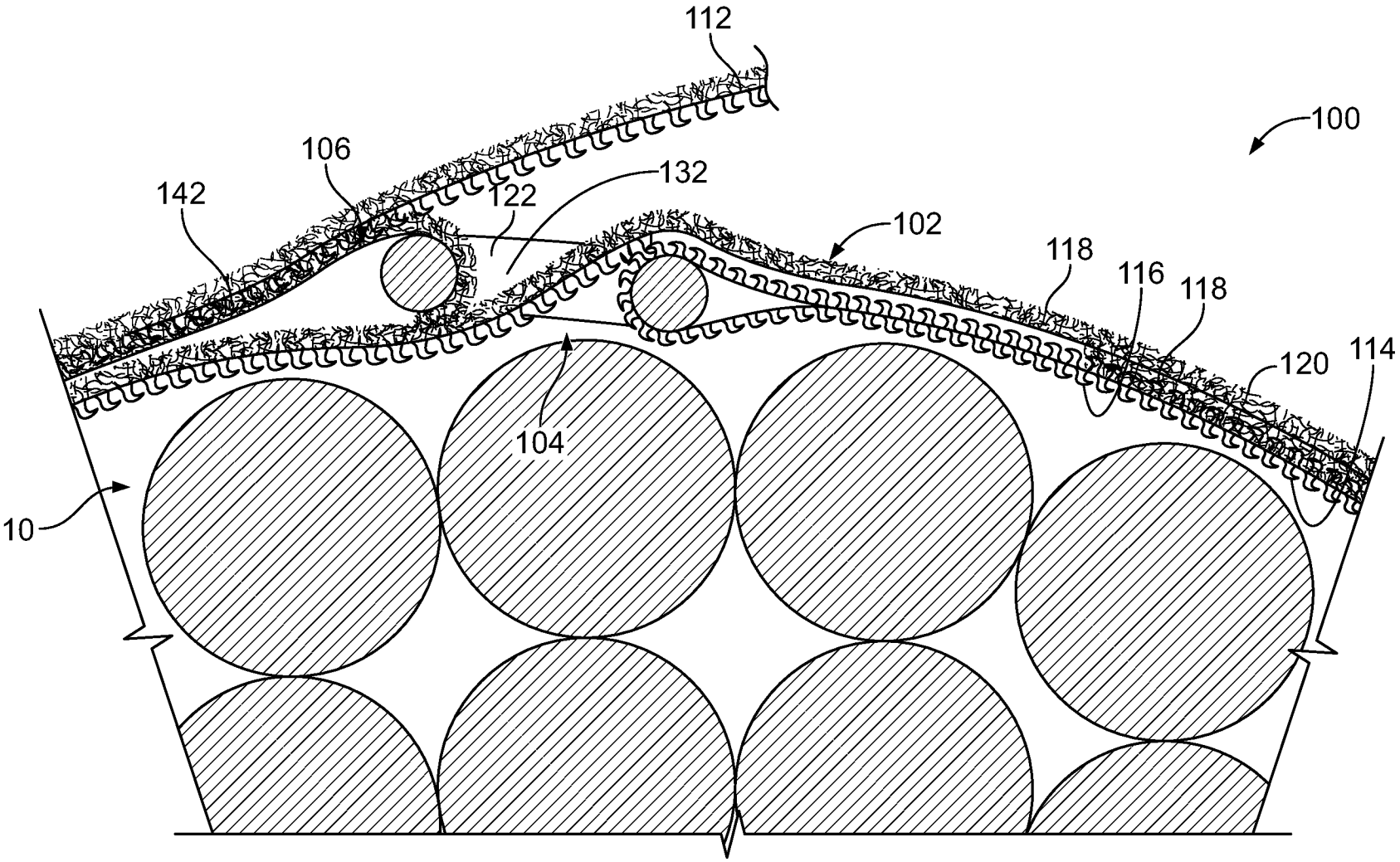
Figure 8A:
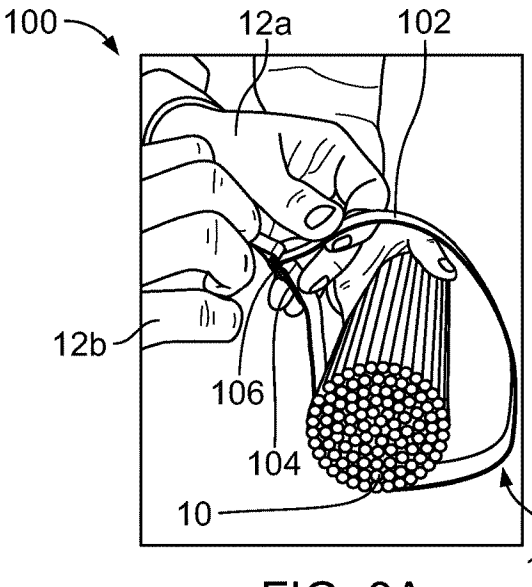
FIGS. 8A-8E are sequential diagrams illustrating installation of the cinching device of FIG. 1 in the second orientation of FIGS. 7A-7B.
Figure 8B:
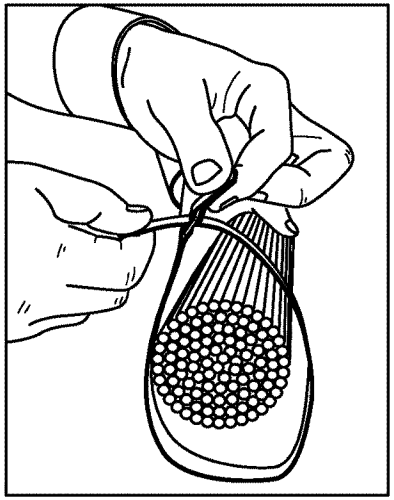
Figure 8C:
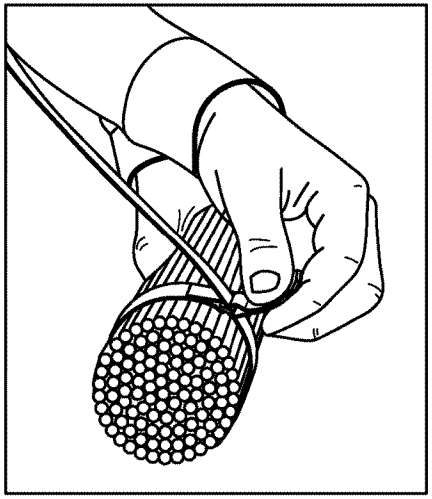
Figure 8D:
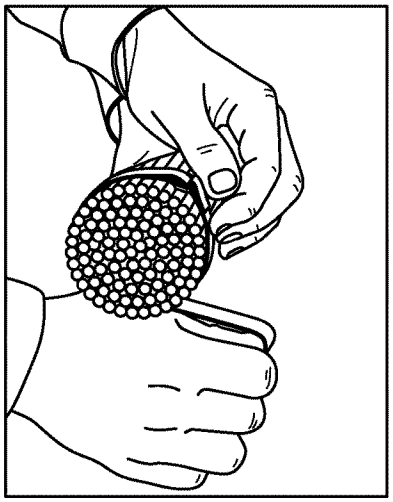
Figure 8E:
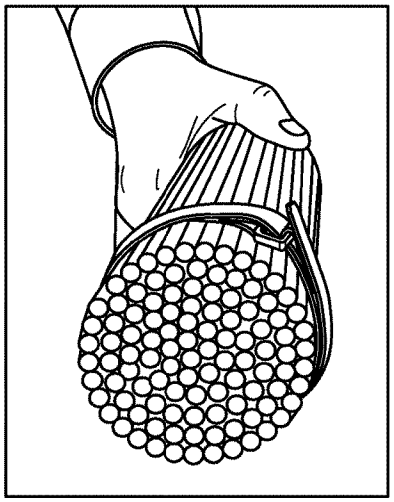

Turning now to FIGS. 7A and 7B, cinching device 100 is depicted securing cables 10 in an orientation that prevents ratcheting against material of the tab. In this orientation, strap 102 is arranged loop-side-out, with its second face 118 directed outward, away from cables 10, and its first face 114 directed inward. As in the prior installation orientation, strap 102 is wrapped loosely around cable bundle 10, and its distal tongue 112 is inserted through the central opening 132 of the buckle's frame 122. Strap 102 is then tightened around cables 10 by advancing strap further through buckle 104. As shown, loop material 142 of tab 106 abuts the outwardly facing loop material 120 of strap 102, so there is no engagement and no ratcheting effect. An advantage of this alternate wrap orientation is that the likelihood of cinching device 100 snagging onto external objects/structures is mitigated due to the inward facing fastening elements 116. To secure the tightened strap 102 in place, the inwardly facing fastener elements 116 are engaged with the outwardly facing loop material 120 of strap 102, as well as loop material 142 of tab 106 if the length of strap 102 is long enough to wrap around the bundle of cables 10 twice (see FIG. 7B).

FIGS. 8A-8E illustrate the above-described installation sequence with cinching device 100 oriented such that strap 102 is loop-side-out. Note how one of the user's hands 12*a* grasps tab 106 to hold buckle 104 in place (FIGS. 8C-8D) as strap 102 is tightened around the bundle of cables 10 with the opposite hand 12*b*.

Figure 9:
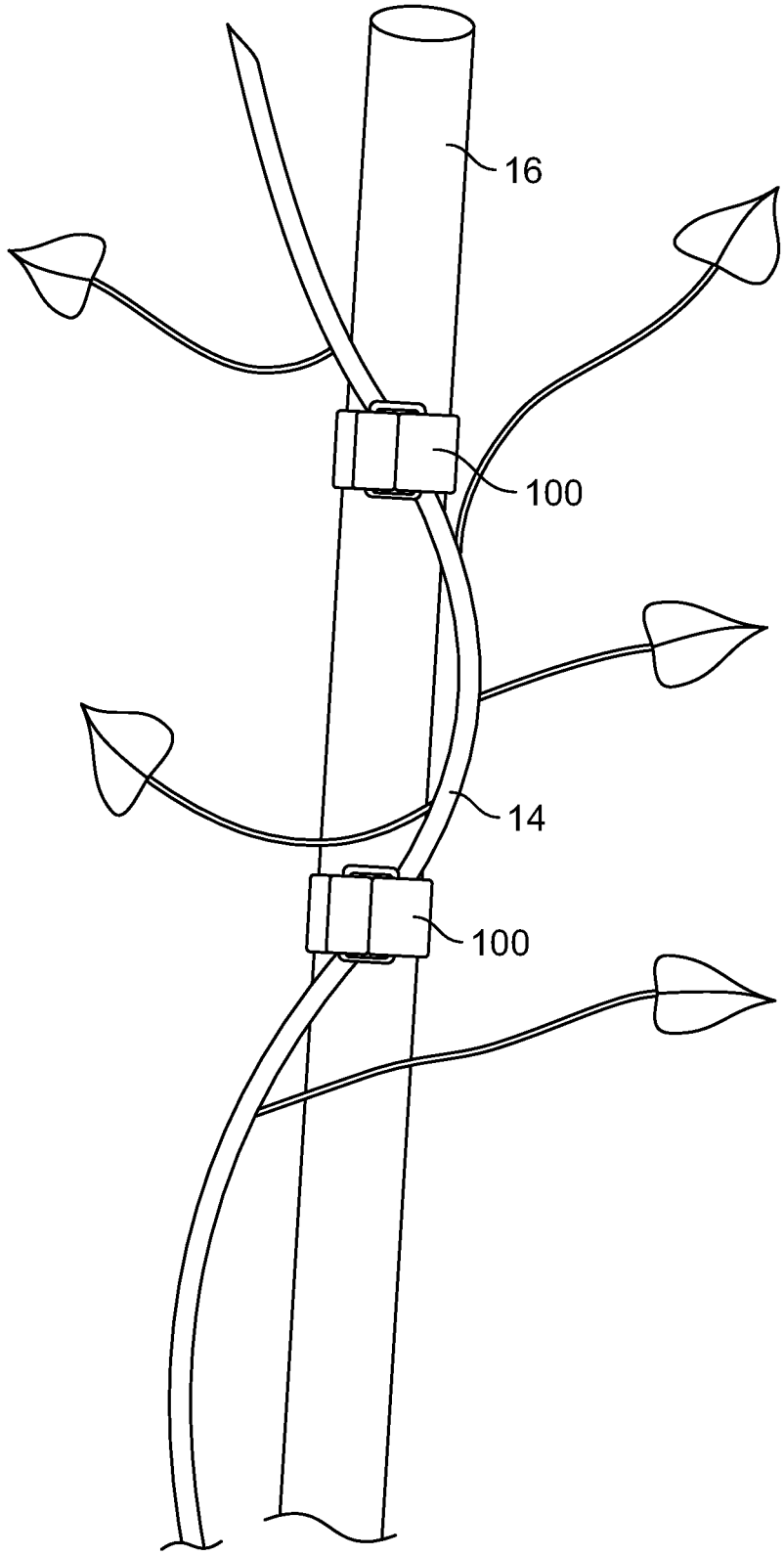
FIG. 9 is a perspective view of a plant secured to a support stake by cinching devices.
Figure 10A:
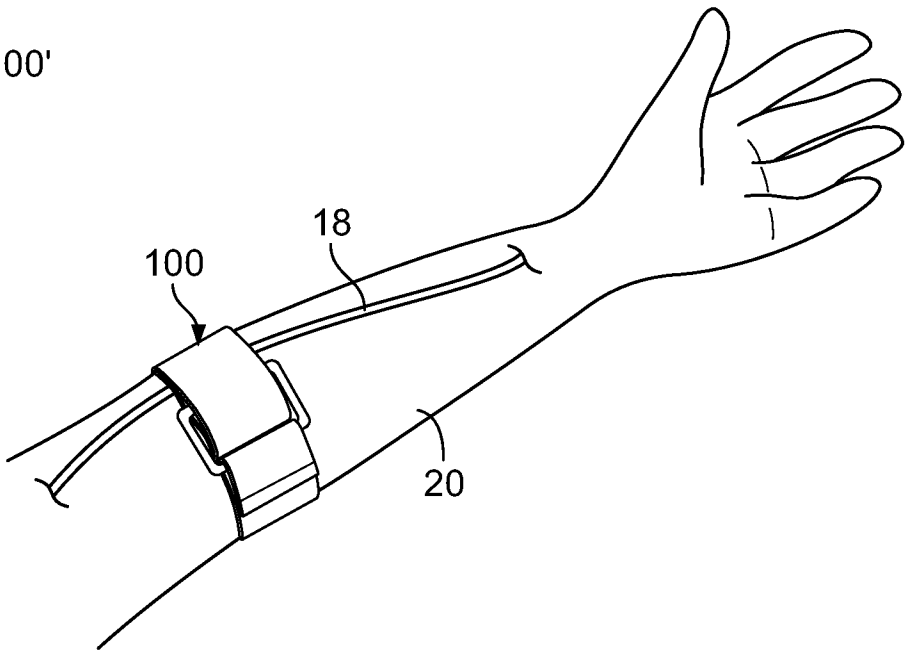
FIGS. 10A-10B are perspective views of a medical tube secured to a patient's arm by a cinching device.
Figure 10B:
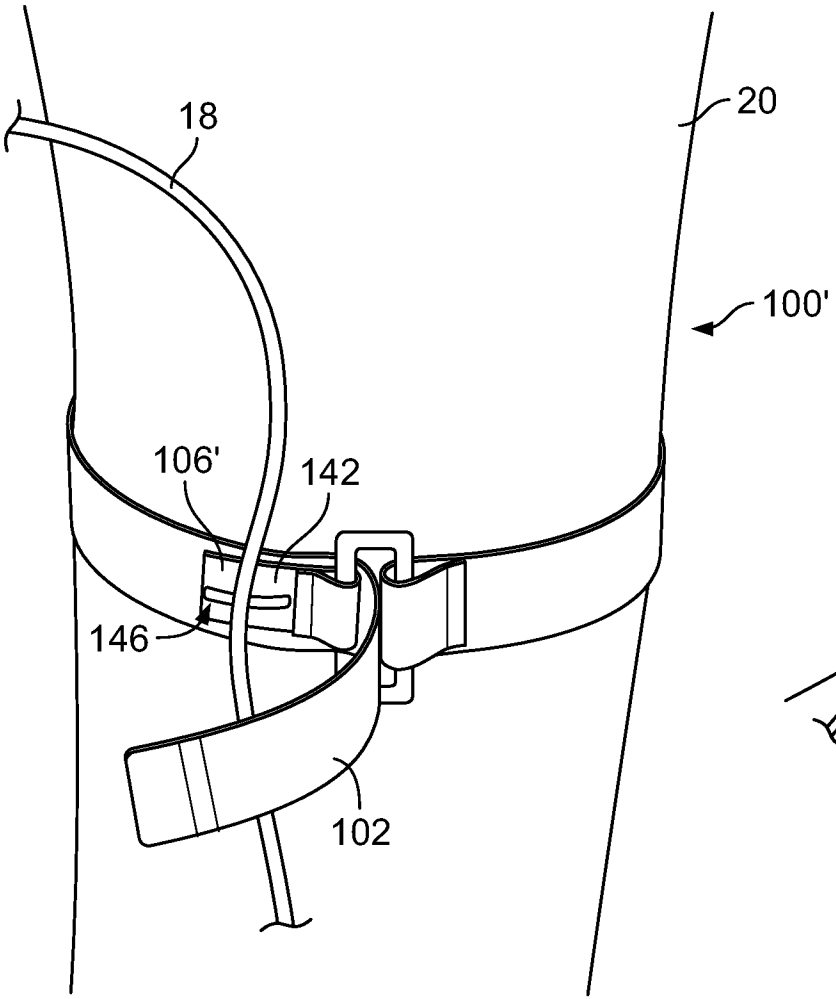

FIGS. 9-10B depict a few of the many envisioned uses of cinching device 100. These examples are provided merely for demonstrative purposes and are not intended to limit the scope of this disclosure. In the example of FIG. 9, two cinching devices 100 are used to secure the stalk of a plant 14 to a stake 16. This particular application may benefit from the hook-side-out orientation for at least two reasons. First, this orientation enables one-handed installation, allowing the user to steady the stake 16 with one hand while tightening the strap of cinching device 100 with the other hand. Second, arranging the loop material inward towards the plant 14 may inhibit damage to its stalk, as could occur if the hooks were pressed against it.

In the example, of FIG. 10A cinching device 100 is used in the hook-side-out orientation to secure a medical conduit 18 to a patient's arm 20. Like the prior example, the hook-side-out orientation may be advantageous in the medical context due to the one-handed installation capability and the increased user comfort from placing the comparatively soft loop material against the patient's skin, as opposed to the hooks. FIG. 10B illustrates a cinching device 100' applied in a similar fashion. In this example, however, tab 106' includes a strip of grip material 146 extending along its length. Grip material 146 can be applied to tab 106' using a variety of techniques. For example, grip material 146 could be deposited atop loop material 142. Alternatively, grip material 146 could be applied to a surface of the base of tab 106' opposite loop material 142, with the edges of the base folded inward to leave a portion of grip material 146 exposed. A detailed description of this process is described below with respect to FIGS. 12A-12B and in U.S. Pat. No. 9,339,085, the entirety of which is incorporated herein by reference. Returning to FIG. 10B, medical conduit 18 is placed against grip material 146, rather than the patient's arm 20 as depicted in FIG. 10A, and strap 102 is folded back over tab 106', such that the outwardly facing male fastening elements engage the loop material of tab 106' to secure medical conduit 18 to cinching device 100' as cinching device 100' is secured to patient's arm 20.

Figure 11A:
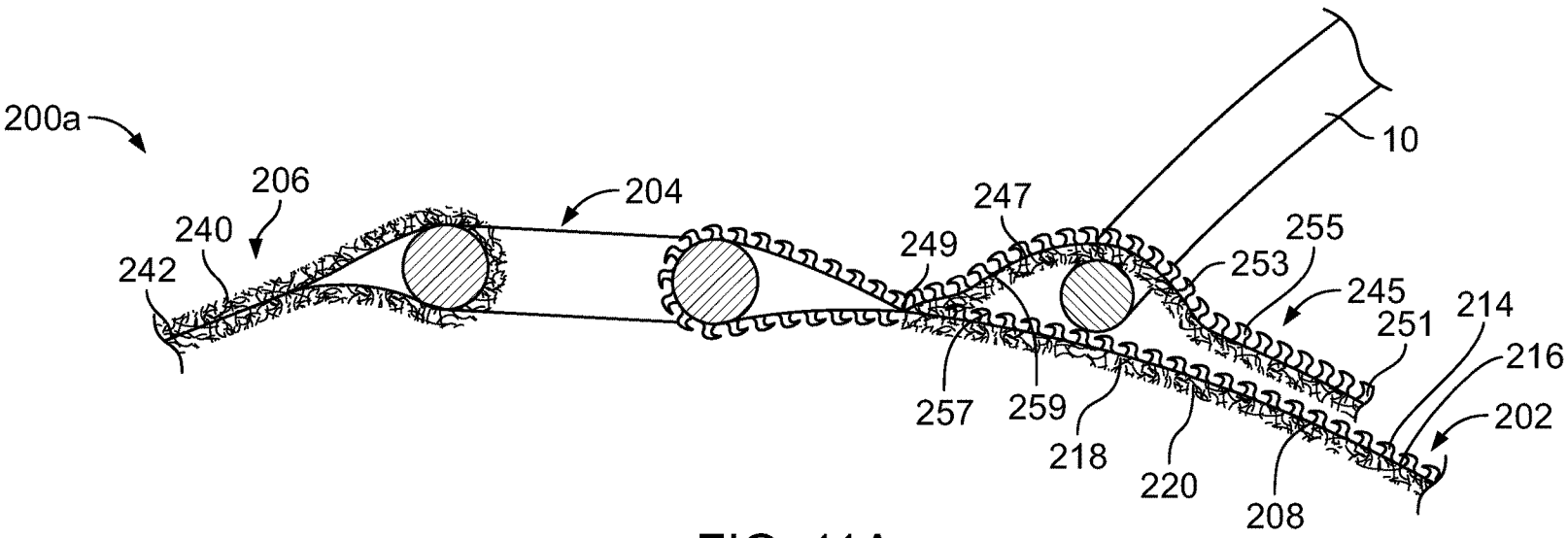
FIGS. 11A-11B are cross-sectional side views illustrating cinching devices secured to an end portion of a cable.
Figure 11B:
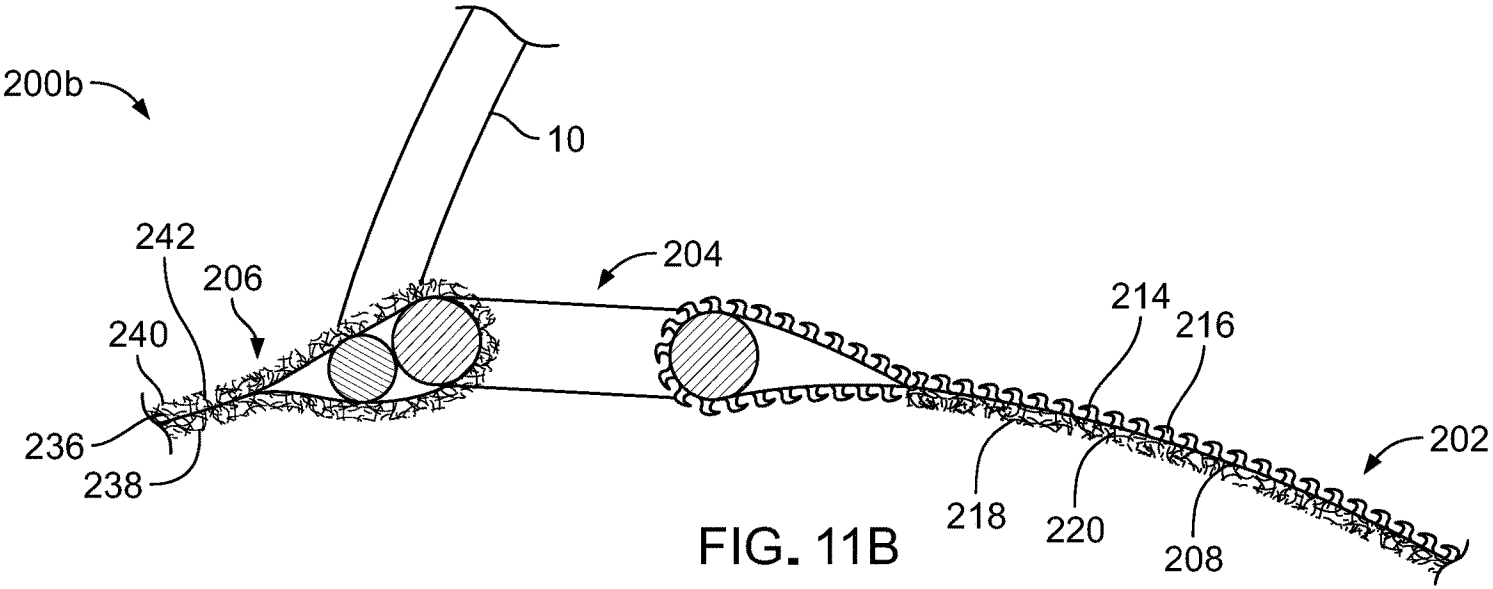

FIGS. 11A and 11B depict example cinching devices 200*a*,200*b*, each of which includes a touch fastening strap 202, a buckle 204, and a tab 206 configured similarly to cinching device 100 described above. Accordingly, strap 202 includes a base 208 having a first face 214 carrying male fastening elements 216 and a second face 218 carrying loop material 220; and tab 206 includes an outer touch fastening face 240 carrying loop material 242. Cinching devices 200*a*,200*b* are further configured to facilitate retention of a portion of a cable 10, such that cinching devices 200*a*,200*b* remain tethered to cable 10 in an uninstalled state—e.g., a state where strap 202 is not wrapped around a cable bundle. This tethering effect enables the cinching device to remain associated with the cable during its use, and therefore mitigates the risk that the cinching device will be unintentionally discarded or misplaced.

In the example of FIG. 11A, this functionality is provided by an auxiliary fastening strap 245 permanently attached (e.g., via welding, fusing, stitching, or the like) to the first face 214 of strap 202. Auxiliary strap 245 includes a base 247 extending longitudinally between a proximal end 249 providing an attachment point to strap 202 and a freestanding distal end 251. A first face 253 of base 250 carries an array of discrete male fastening elements 255, and a second face 257 carries a field of loop material 259. As shown, retention of cable 10 is achieved by simply placing cable 10 between the primary and auxiliary straps 202,245 and engaging loop material 259 of strap 245 with male fastening elements 216 of strap 202. The outwardly facing fastening elements 255 of auxiliary strap 245 provide an engagement point for loop material 220 on the second face of primary strap 202. Cable 10 can easily be released by peeling back distal end 251 of auxiliary strap 245. As shown in FIG. 11B, cinching device 200*b* provides similar functionality by securing a portion of cable 10 between the attached ends 236,238 of tab 206.

Figure 12A:
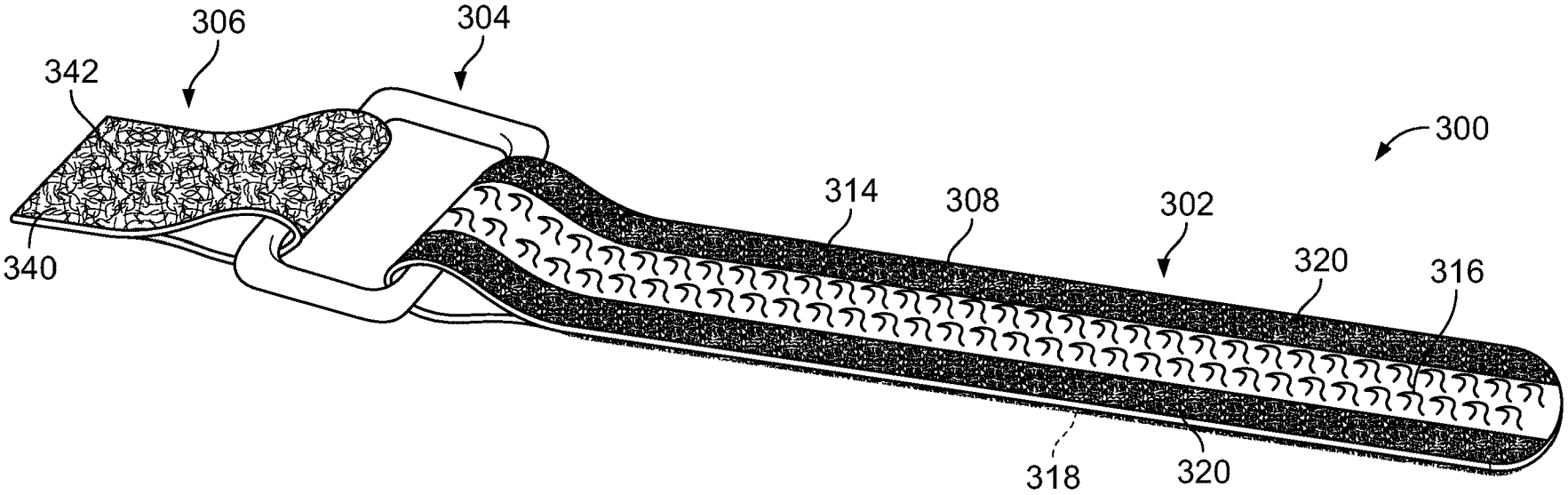
FIGS. 12A-12C are perspective and cross-sectional side views of a cinching device including deposits of a relatively soft resinous material.
Figure 12B:
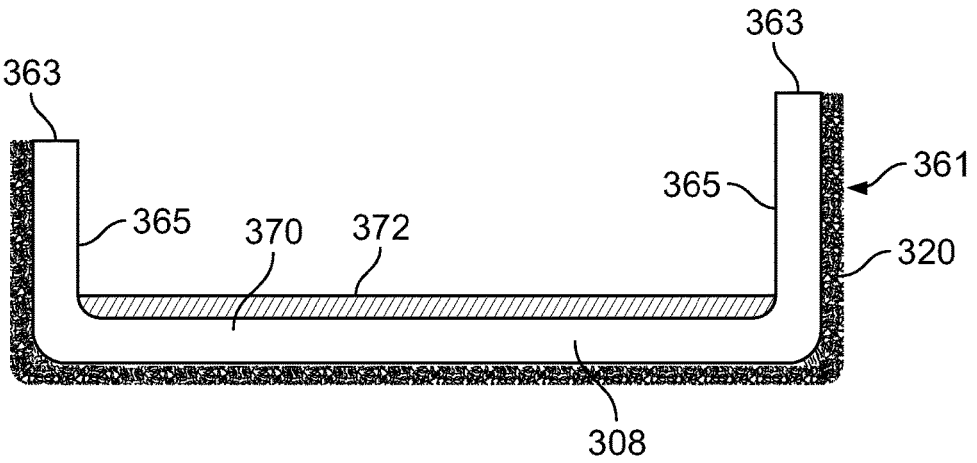
Figure 12C:
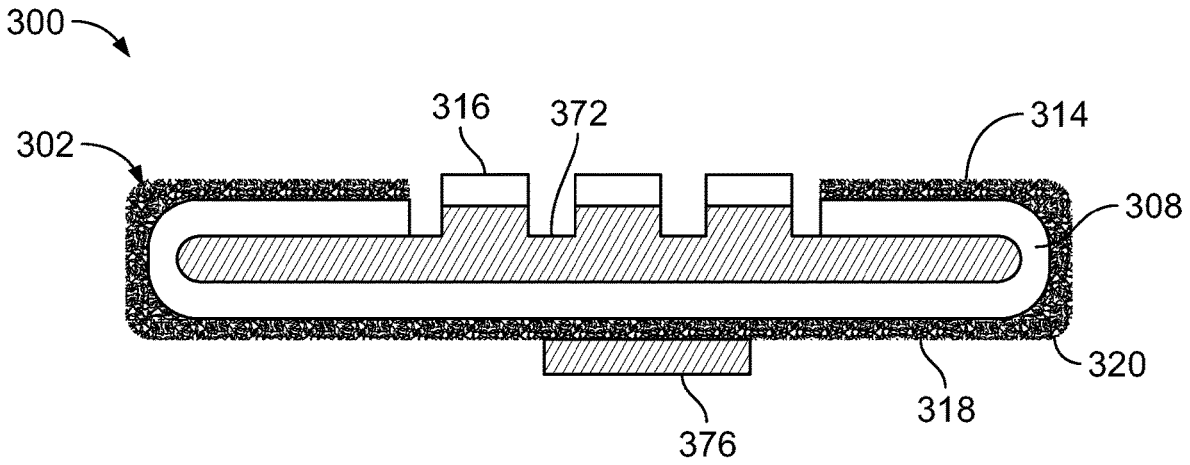

FIGS. 12A-12C depict yet another cinching device 300. Similar to the prior examples, cinching device 300 includes a touch fastening strap 302, a buckle 304, and a tab 306. Strap 302 includes a base 308 having a first face 314 and a second face 318; and tab 306 includes an outer touch fastening face 340 carrying loop material 342. In this example, strap 302 is a double-sided loop construction fashioned from a preform elongated strip 361 including a carrying loop material 320 on flexible base 308. Longitudinal edges 363 of base 308 are folded over to form inwardly facing arms 365, and an inboard portion 370 between arms 365 provides a bed for a layer of resinous material 372. Longitudinal edges 366 are folded over the outer portions of the layer of material 372, such that outer portions of the layer are sandwiched between arms 368 and inboard portion 370 of base 308, while a center portion of the layer of material 372 remains exposed between edges 363. Note that the folded longitudinal edges can be secured in place using an appropriate adhesive, sewing or by heat staking, as described in U.S. Pat. No. 9,339,085. In some examples, the resinous material itself serves as an adhesive, such that the folded edges are held in place against the base solely by adhesion from the material. An array of discrete male touch fastening elements 316 are then molded from the exposed central portion of resinous material 372. The resulting strap 302 features a first face 314 carrying a longitudinal strip of loop-engageable touch fastening elements 316 bordered by opposite edge regions of loop material 320. The strap's second face 318 is broadly covered with loop material 320, as in previous examples, and further includes a deposited layer of grip material 376 atop the loops.

Resinous material 372 and/or grip material 376 can have any appropriate composition so as to provide a substantially non-slip surface. By "non-slip" surface, we refer to any surface designed to inhibit or prevent a smooth slipping or sliding motion by providing adequate surface friction (e.g., a material having a dynamic coefficient of friction greater than about 0.3). Additionally, resinous material 372 and/or grip material 376 may be generally "soft" or "skin friendly" to the touch. For example, soft elastomers (e.g., styrenic block copolymers, such as styrene-isoprene-styrene, styrene isoprene/butadiene styrene, and styrene-butadiene-styrene), rubbers (e.g. flouroelastomers) or silicones can be used. Other suitable compositions can also be used, e.g., various plastics with modified lower molecular weight constituents and thermoplastic elastomers (e.g., modified polypropylene or modified polyethylene). In some examples, the resinous/grip material is particularly well designed for skin contact, featuring a tack free, non-allergenic, and non-irritant composition. These non-slip and skin friendly characteristics render cinching device 300 particularly well suited for applications involving medical and/or sports straps.

Figure 13A:
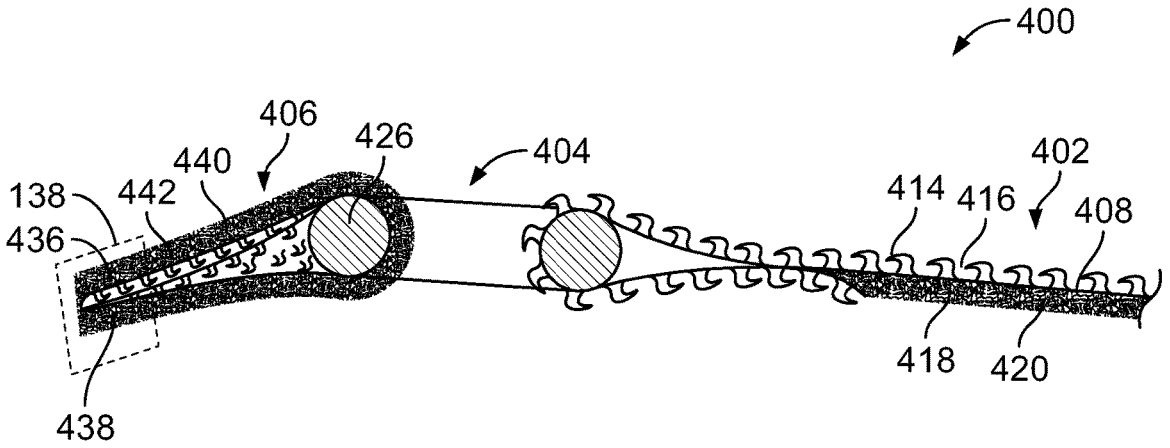
FIGS. 13A-13B are cross-sectional side views of a cinching device including a tab with a hook-to-hook closure mechanism.
Figure 13B:
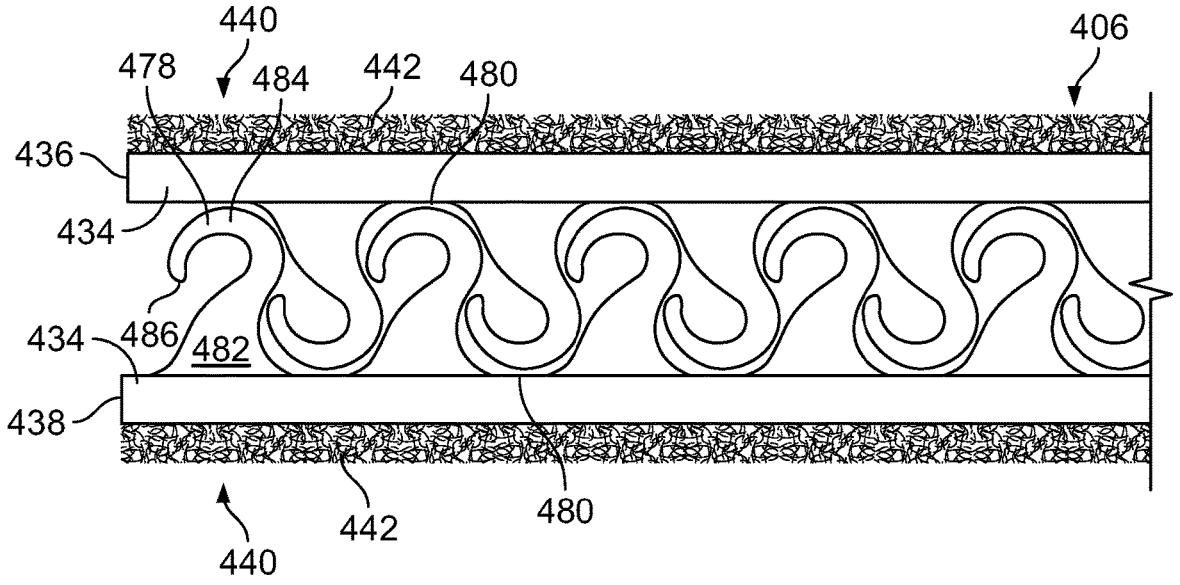

FIGS. 13A-13B depict another cinching device 400 including a touch fastening strap 402, a buckle 404, and a tab 406. Strap 402 includes a base 408 having a first face 414 carrying male fastening elements 416 and a second face 418 carrying loop material 420; and tab 406 includes an outer touch fastening face 440 carrying loop material 442. While in other examples, the opposing ends 436,438 of the tab's base 434 were permanently attached by stitching, fusing, or welding, in this example, tab 406 is secured to the buckle's arm 426 by a closure mechanism provided by mating male fastening elements 478 formed along an inner face 480 of tab 406, allowing tab 406 to be easily removed and/or reattached to configure the strap for different uses. Each of fastening elements 478 includes a molded stem 482 extending to a head 484 that terminates in a distal tip 486. As shown, the curvature of these features enables the head of one element to be received between the stems of two elements on the opposite of the base, and vice versa. Further details regarding these male fastening elements are provided in U.S. Pat. No. 8,225,467, the entirety of which is incorporated in this disclosure by reference. In the context of the cinching device described in this disclosure, hook-engageable fastening elements may enhance the rigidity of the loop tab, and therefore inhibit the tab from rolling/folding over itself during use.

Figures 14A, 14B:
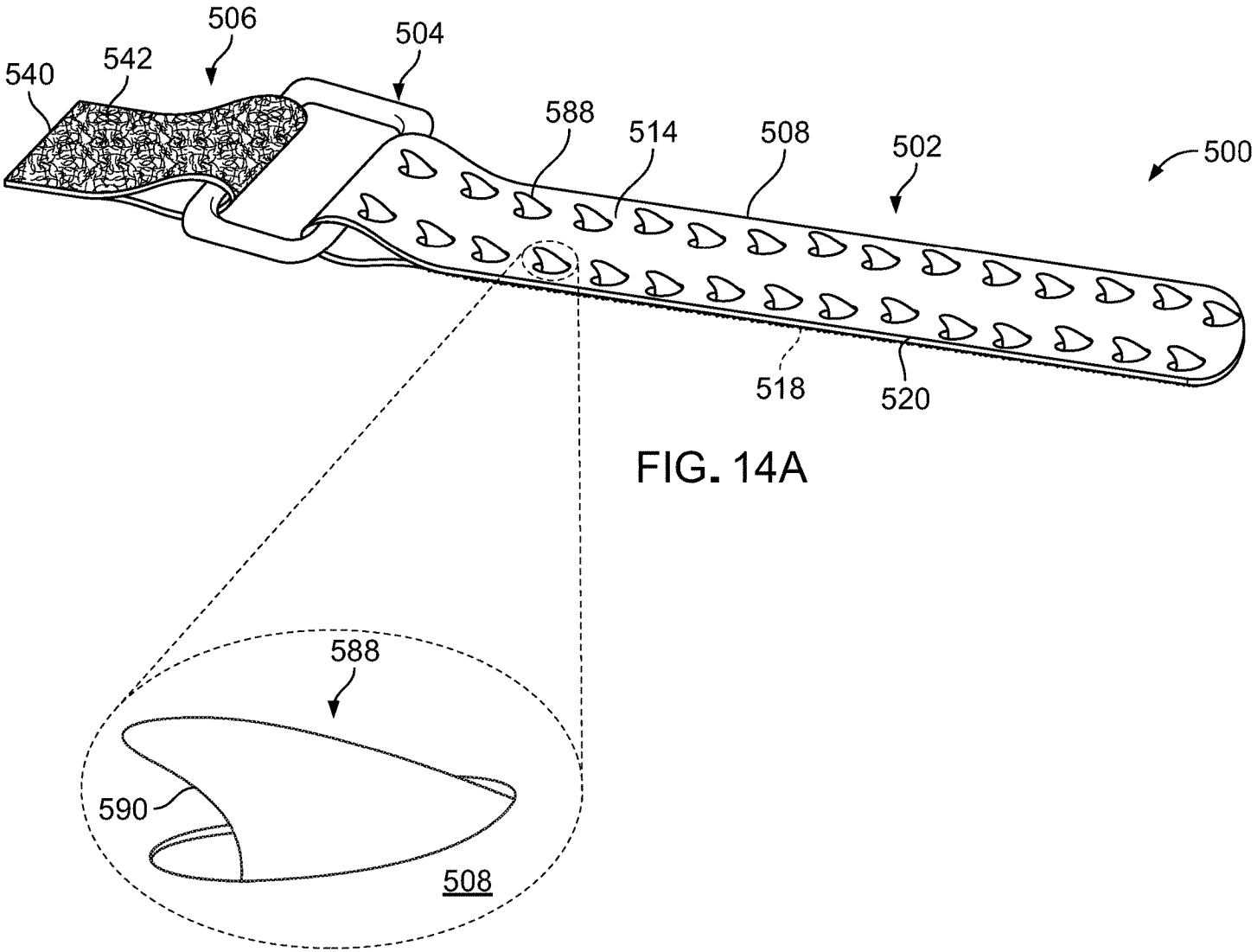
FIG. 14A-14B are perspective top views of a cinching device including upstanding loop-engageable barbs.

FIGS. 14A-14B illustrate a cinching device 500 configured similarly to the previous examples. Accordingly, cinching device 500 includes a touch fastening strap 502, a buckle 504, and a tab 506. Strap 502 includes a base 508 having a first face 514 carrying discrete fastening elements 588 and a second face 518 carrying loop material 520; and tab 506 includes an outer touch fastening face 540 carrying loop material 542. In this example, fastening elements 588 are provided in the form of upstanding barbs punched through base 508. More specifically, fastening elements 588 are fashioned by puncturing through base 508 to form cutout protrusions. As shown in FIG. 14B, fastening elements 588 include an inwardly curved front surface 590 rising from the surrounding planar surface of base 508 for snagging loop fibers. Similar to the prior examples, fastening elements 588 are formed in a unidrectional array, so as to provide substantial shear resistance in only one of two longitudinal directions. The base may be of molded resin of sufficient thickness that punched barbs retain shear-resisting rigidity as raised from the surrounding surface. For very high load applications, base 508 may be a flexible metal strip to which the loop material is adhered. The barbs may be punched either before or after the base is laminated to the loop.

Figure 15:
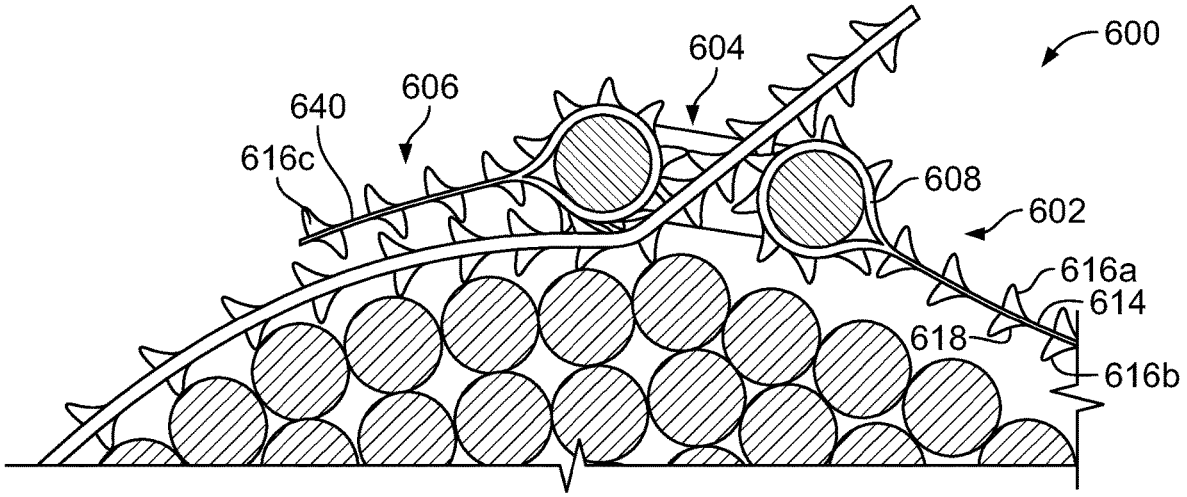
FIG. 15 is a cross-sectional side view of a cinching device including wedge-shaped fastening elements.
Figure 15A:
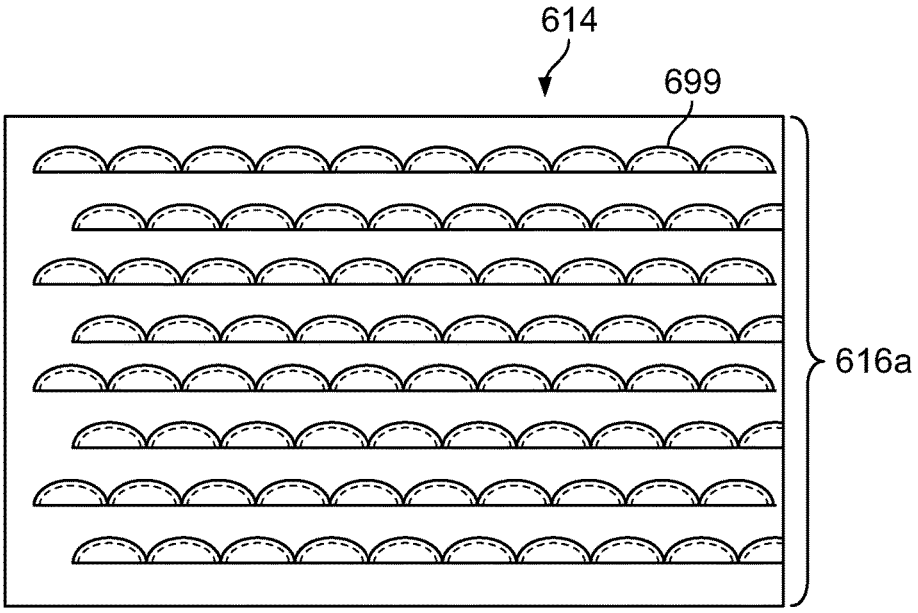
FIG. 15A is a top view of a portion of the cinching device of FIG. 15.

FIGS. 15 and 15A show a cinching device 600 including self-engageable wedge-shaped fastening elements (so called 'fish scale' elements). These fish scale elements and molding techniques for manufacturing the same are described in detail by U.S. Pat. No. 7,478,460, the entirety of which is incorporated herein by reference. As in previous examples, cinching device 600 includes a touch fastening strap 602, a buckle 604, and a tab 606. Strap 602 includes a base 608 having a first face 614 carrying a first array of fastening elements 616*a* extending unidirectionally to overhang face 614 and a second face 618 carrying a second unidirectional array of fastening elements 616*b*. Tab 606 includes an outer touch fastening face 640 carrying an additional array of fish scale fastening element 616*c*. The upstanding engageable side 699 of each fastening element 616*a, b,c* is curved (e.g., circular), giving the elements a fish scale appearance, as depicted in FIG. 15A (top view of first face 614). Engagement between respective arrays of fish scale fastening elements exhibit particularly strong shear characteristics, and therefore are particularly well suited for forming the above-described touch fastening ratchet mechanism between tab 606 and strap 602 as the strap is pulled through buckle 604. Further, fish scale fastening elements can be formed in a manner that provides a relatively high-degree of strap flexibility and a relatively low-degree of skin irritability, making cinching device 600 suitable for medical applications (or any other application where skin contact with the strap is likely).

Figure 16:
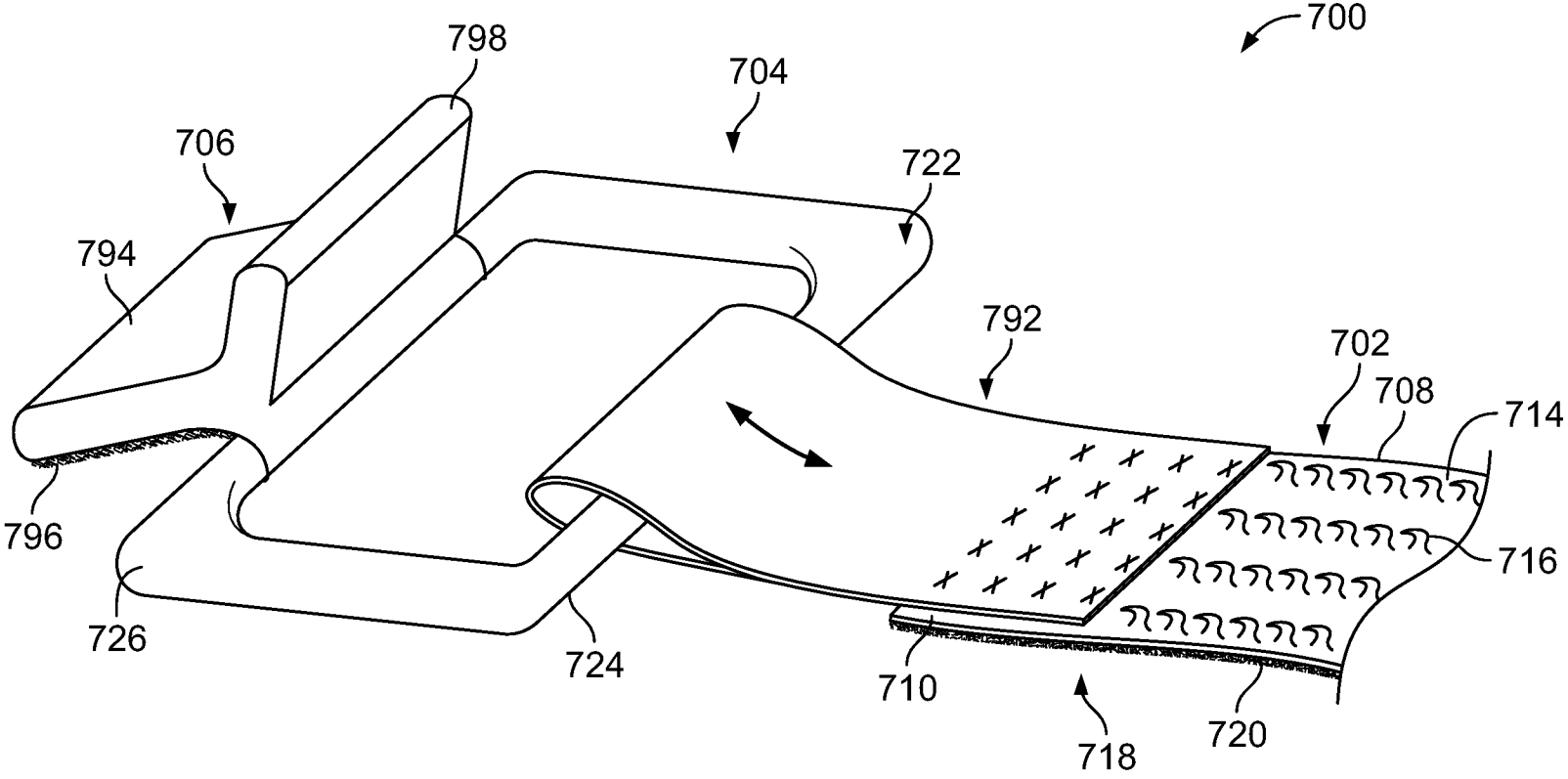
FIG. 16 is a perspective top view of a cinching device including an integrally molded tab and an elastic stretchable band.

FIG. 16 depicts yet another cinching device 700 including a touch fastening strap 702, a buckle 704, and a tab 706. Similar to other examples, strap 702 includes a base 708 having a first face 714 carrying male fastening elements 716 and a second face 718 carrying loop material 720. However, in this example, the strap's proximal end 710 is anchored to buckle 704 by an elastically stretchable band 792, which is looped around the arm 724 of the buckle's frame 722. The elastic nature of stretchable band 792 enhances the tenacity of the engagement between male fastening elements 716 and loop material 720 during use. More specifically, when fastening elements 716 and loop material 720 are placed in an engaged state with band 792 in a stretched condition, the elasticity of band 792 applies a pulling force along strap 702 to hold the closure in shear.

Additionally, in the present example, tab 706 is provided in the form of a rigid structure, which may be fused or formed integrally with arm 726 of the buckle's frame 722, or may be joined to the buckle at a rotatable joint. The rigid tab 706 includes a fastening flange 794 carrying an array of discrete male fastening elements 796 on its underside and an upstanding ridge 798 extending from the topside of flange 794. Fastening elements 796 are appropriately configured (e.g., shaped and sized) for engaging the loop material 720 of strap 702 and arranged unidirectionally to provide the ratcheting effect described above. As shown, flange 794 has a slightly curved profile to follow the contour of one or more objects to be secured by cinching device 700. Ridge 798 is provided to facilitate handling of tab 706 by a user. For example, a user may grip ridge 798 to manipulate tab 706 or push ridge 798 with a finger to apply a lifting force sufficient to release tab 706 from strap 702, or to better hold tab 706 in an orientation to prevent premature engagement with the strap surface during installation.

Note that the above-described features of FIG. 16, particularly elastically stretchable band 792 and rigid tab 706, while depicted as constituent components of the same example cinching device 700, may be employed separately without departing from the scope of the present disclosure.

A number of embodiments of the invention have been described. Nevertheless, it will be understood that various modifications may be made without departing from the spirit and scope of the inventions.

What is claimed is:

1. A cinching device comprising:

a buckle comprising a frame defining an opening;

an elongate flexible strap coupled to one portion of the frame and extending away from the frame to a free-standing tongue receivable by the opening of the frame, the strap comprising a first face carrying a plurality of loop-engageable discrete fastening elements and an opposing second face carrying a loop material, the plurality of fastening elements disposed in an array spanning a length between a proximal region of the strap coupled to the frame and a distal region of the strap including the tongue, and a significant majority of the plurality of fastening elements extending unidirectionally to overhang the first face of the strap; and a tab coupled to another portion of the frame, the tab including an exposed touch fastening face engageable with at least one of: the plurality of fastening elements of the first face of the strap or the loop material of the second face of the strap, wherein the significant majority of the plurality of fastening elements is configured to interface with the touch fastening face of the tab within the opening of the frame, such that movement of the strap through the opening in a tightening direction is permitted and movement of the strap through the opening in a loosening direction is inhibited by engagement of the significant majority of fastening elements with the touch fastening face of the tab.

2. The cinching device of claim 1, wherein the array of fastening elements extends across a limited width portion of the first face of the strap.

3. The cinching device of claim 1, wherein the tab and flexible strap are permanently attached to the frame of the buckle.

4. The cinching device of claim 1, wherein each of the plurality of fastening elements comprises an upstanding stem rising from the first face of the strap and a head protruding integrally from a distal end of the stem to a tip, and wherein the plurality of fastening elements and the strap comprise a molded contiguous mass of solidified resin.

5. The cinching device of claim 1, wherein the touch fastening face of the tab comprises at least one of:

a loop material engageable with the fastening elements of the first face of the strap; or a plurality of fastening elements engageable with the loop material of the second face of the strap.

6. The cinching device of claim 5, wherein substantially all of the fastening elements of the tab extend unidirectionally to overhang the touch fastening face.

7. The cinching device of claim 1, wherein the tab comprises a rigid body extending integrally from the frame.

8. The cinching device of claim 1, wherein at least one of the tab or the strap carries an elongated strip of resinous grip material.

9. The cinching device of claim 1, wherein the flexible strap is a primary strap, and wherein the cinching device further comprises an auxiliary fastening strap attached to the primary strap to overlap the first face of the primary strap, the auxiliary fastening strap comprising opposing touch fastening faces, at least one of which carrying a loop material engageable with the plurality of fastening elements of the first face.

10. The cinching device of claim 1, further comprising an elastically stretchable band securing the strap to the frame of the buckle.

11. The cinching device of claim 1, wherein the touch fastening face of the tab overlaps a portion of the strap when the tongue of the strap is received by the opening of the frame.

12. A cinching device comprising:

a buckle comprising a frame defining an opening;

an elongate flexible strap coupled to one portion of the frame and extending away from the frame to a free-standing tongue receivable by the opening of the frame, the strap comprising a first face carrying a plurality of loop-engageable discrete fastening elements and an opposing second face carrying a loop material, the plurality of fastening elements disposed in an array spanning a length between a proximal region of the strap coupled to the frame and a distal region of the strap including the tongue; and a tab coupled to another portion of the frame, the tab including an exposed touch fastening face engageable with at least one of: the plurality of fastening elements of the first face of the strap or the loop material of the second face of the strap, wherein the touch fastening face of the tab overlaps a portion of the strap when the tongue of the strap is received by the opening of the frame, and wherein the plurality of fastening elements is configured to interface with the touch fastening face of the tab within the opening of the frame, such that movement of the strap through the opening in a tightening direction is permitted and movement of the strap through the opening in a loosening direction is inhibited by engagement of the plurality of fastening elements with the touch fastening face of the tab.

13. The cinching device of claim 12, wherein the tab and flexible strap are permanently attached to the frame of the buckle.

14. The cinching device of claim 12, wherein each of the plurality of fastening elements comprises an upstanding stem rising from the first face of the strap and a head protruding integrally from a distal end of the stem to a tip, and wherein the plurality of fastening elements and the strap comprise a molded contiguous mass of solidified resin.

15. The cinching device of claim 12, wherein the touch fastening face of the tab comprises at least one of:

a loop material engageable with the fastening elements of the first face of the strap; or a plurality of fastening elements engageable with the loop material of the second face of the strap.

16. The cinching device of claim 15, wherein substantially all of the fastening elements of the tab extend unidirectionally to overhang the touch fastening face.

17. The cinching device of claim 12, wherein the tab comprises a rigid body extending integrally from the frame.

18. The cinching device of claim 12, wherein at least one of the tab or the strap carries an elongated strip of resinous grip material.

19. The cinching device of claim 12, wherein the flexible strap is a primary strap, and wherein the cinching device further comprises an auxiliary fastening strap attached to the primary strap to overlap the first face of the primary strap, the auxiliary fastening strap comprising opposing touch fastening faces, at least one of which carrying a loop material engageable with the plurality of fastening elements of the first face.

20. The cinching device of claim 12, further comprising an elastically stretchable band securing the strap to the frame of the buckle.

21. A cinching device comprising:

a buckle comprising a frame defining an opening;

an elongate flexible strap coupled to one portion of the frame and extending away from the frame to a free-standing tongue receivable by the opening of the frame, the strap comprising a first face carrying a plurality of loop-engageable discrete fastening elements and an opposing second face carrying a loop material, the plurality of fastening elements disposed in an array spanning a length between a proximal region of the strap coupled to the frame and a distal region of the strap including the tongue; and a tab coupled to another portion of the frame, the tab including an exposed touch fastening face engageable with at least one of: the plurality of fastening elements of the first face of the strap or the loop material of the second face of the strap, wherein engagement of the tab with the strap defines a shear plane parallel to the touch fastening face of the tab, the shear strength of the engagement being greater in one longitudinal direction along the shear plane than in an opposite longitudinal direction, and wherein the plurality of fastening elements is configured to interface with the touch fastening face of the tab within the opening of the frame, such that movement of the strap through the opening in a tightening direction is permitted and movement of the strap through the opening in a loosening direction is inhibited by engagement of the plurality of fastening elements with the touch fastening face of the tab.

* * * * *